US008820869B2

(12) United States Patent
Kumagai et al.

(10) Patent No.: US 8,820,869 B2
(45) Date of Patent: Sep. 2, 2014

(54) RECORDING DEVICE

(71) Applicant: Seiko Epson Corporation, Tokyo (JP)

(72) Inventors: Katsunari Kumagai, Okaya (JP); Kazumasa Harada, Matsumoto (JP); Kazutoshi Matsuzaki, Shiojiri (JP); Satoshi Nakata, Matsumoto (JP); Hidetaka Kawata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/935,771

(22) Filed: Jul. 5, 2013

(65) Prior Publication Data

US 2014/0009518 A1 Jan. 9, 2014

(30) Foreign Application Priority Data

Jul. 6, 2012 (JP) ..... 2012-152144

(51) Int. Cl.
*B41J 25/308* (2006.01)
*B41J 23/12* (2006.01)
*B41J 2/04* (2006.01)

(52) U.S. Cl.
CPC ..... *B41J 2/04* (2013.01); *B41J 25/3082* (2013.01)
USPC ..... 347/8; 347/37

(58) Field of Classification Search
CPC ..... B41J 25/3082
See application file for complete search history.

(56) References Cited

U.S. PATENT DOCUMENTS

2005/0253880 A1* 11/2005 Nakamura et al. ..... 347/8
2007/0008352 A1* 1/2007 Koh et al. ..... 347/8
2007/0122220 A1 5/2007 Tamaki et al.
2009/0309921 A1 12/2009 Ohyama et al.
2010/0201743 A1* 8/2010 Miyata ..... 347/37
2010/0231643 A1* 9/2010 Saiga et al. ..... 347/37
2011/0141192 A1* 6/2011 Komuro et al. ..... 347/37

FOREIGN PATENT DOCUMENTS

JP 2005271531 A * 10/2005
JP 2010-023501 2/2010
JP 2011-031627 2/2011

* cited by examiner

*Primary Examiner* — Shelby Fidler
(74) *Attorney, Agent, or Firm* — Workman Nydegger

(57) ABSTRACT

A recording apparatus includes a recording head performing recording on a recording medium, a carriage movable in a scanning direction of the recording head; a first guide member guiding the carriage in the scanning direction; a second guide member provided positioned at a predetermined distance in a direction intersecting the scanning direction with respect to the first guide member; a first gap adjusting unit provided on the carriage, and causing the housing of the carriage to displace in a direction changing the gap between a support face supporting a recording medium and the recording head; a second gap adjusting unit causing the housing of the carriage to displace by being synchronized with the first gap unit in a direction changing the gap; a synchronization unit.

6 Claims, 20 Drawing Sheets

RECORDING DEVICE

BACKGROUND

1. Technical Field

The present invention relates to mechanism adjusting the gap between a recording medium and a recording head and a recording apparatus including the mechanism.

It is assumed herein that ink jet printers, copy machines, fax machines and the like are included in the recording apparatus.

2. Related Art

In the related art, a recording apparatus includes a carriage movable in the scanning direction of the recording head, and on the lower face of the carriage a recording head is provided ejecting ink towards a recording face of a recording medium. Such a recording apparatus executes recording on envelopes, thick paper and optical discs, in addition to regular paper, as a recording medium.

Because the thicknesses of these recording media differ, there is a need for the gap between the recording head and the support face of the recording medium to be changed according to the recording medium, since the distance between the recording face of the recording medium and the recording head changes. Therefore, in a recording apparatus there is a unit adjusting the gap by causing the carriage to move in a direction adjusting the gap between the support face of the recording medium and the recording head according to the type of recording medium (see, for example, JP-A-2010-23501).

In such a recording apparatus, a sliding portion moving in the scanning direction along with the carriage is provided on the rear face side of the carriage, and the sliding portion has a configuration sliding in contact with a direct guide portion. Furthermore, a gap control member is provided interposed between the sliding portion and the carriage. The gap control member is configured so as to change the thickness of the intersecting direction along the scanning direction.

In addition, a displaceable switching member is provided in the chassis of the recording apparatus to freely advance and retreat within the range in which the gap control member slides. In the recording apparatus, by causing the switching portion to abut on the sliding gap control member, and the gap control member to relatively move in the scanning direction with respect to the carriage, the carriage is caused to move in the intersecting direction, and the gap between the recording head and the recording medium is adjusted.

In addition, the recording apparatus includes a support portion provided above the gap control member in the height direction of the recording apparatus. The support portion is formed integrally with the chassis of the recording apparatus, and supports the upper end portion of the carriage. In so doing, the posture of the carriage is maintained by the upper end portion of the carriage being in pressing contact with the support portion under its own weight.

However, in the recording apparatus, the dimensions of the carriage increase in the height direction of the recording apparatus since the support portion is provided above the gap control member, and miniaturization in the height direction of the recording apparatus is difficult. Therefore, there is a recording apparatus in which the front face side and rear face side of the carriage in the apparatus depth direction of the recording apparatus each include a gap adjusting member adjusting the gap and supporting the carriage (see, for example, Japanese Patent No. 4730481).

In the recording apparatus, both ends of the gap adjusting member in the slide direction protrude from the carriage main body. The recording apparatus adjusts the gap by causing the carriage to be moved in the scanning direction, and changing the slide position of the gap adjusting member by both ends in the slide direction being abutted on abutting sites respectively provided at both ends of a pair of guide frames.

SUMMARY

However, in the recording apparatus, since abutting sites abutting the gap adjusting unit are provided at both ends of a guide frame, the length of the guide frame in the scanning direction becomes longer, and leading to size increases in the recording apparatus.

In addition, in the recording apparatus, since both ends of a gap adjusting unit provided on the front face side and rear face side of the carriage protrude from the carriage main body, the paper touches both ends when there is a paper jam, and there is concern of synchronization in two gap adjusting units slipping due to a user unintentionally touching both ends.

An advantage of some aspects of the invention is to provide a recording apparatus able to achieve miniaturization of the apparatus, without shifts of the synchronization occurring in a plurality of gap adjusting units adjusting the gap between the recording head and the support face supporting the recording medium.

According to a first aspect of the invention, there is provided a recording apparatus provided with a recording head performing recording on a recording medium, the apparatus including, a carriage movable in a scanning direction of the recording head; a first guide member guiding the carriage in the scanning direction; a second guide member guiding the carriage in the scanning direction, and provided positioned at a predetermined distance in a direction intersecting the scanning direction with respect to the first guide member; a first gap adjusting unit provided on the carriage, and interposed between the housing of the carriage and the first guide member and causing the housing of the carriage to displace in a direction changing the gap between a support face supporting a recording medium and the recording head; a second gap adjusting unit provided on the carriage, and interposed between the housing of the carriage and the second guide member and causing the housing of the carriage to displace in a direction changing the gap; a synchronization unit provided on the carriage causing the first gap adjusting unit and the second gap adjusting unit to be synchronized.

According to the aspect, since the first gap adjusting unit, the second gap adjusting unit and the synchronization unit causing the first gap adjusting unit and second gap adjusting unit to be synchronized are included on the carriage, there is no need for the first guide member and the second guide member to be long in order to provide abutting portions on the first guide member and the second guide member, and it is possible to achieve miniaturization of the apparatus.

Furthermore, there is no need to provide a supporting portion other than the first gap adjusting unit and the second gap adjusting unit, since the carriage is caused to support first gap adjusting unit and the second gap adjusting unit in sliding contact with the first guide member and the second guide member respectively, and it is possible to miniaturize the carriage, as well as achieve miniaturization of the apparatus.

In addition, since synchronization of the first gap adjusting unit and the second gap adjusting unit is caused by the synchronization unit, there is no shifting of the gap between the first gap adjusting unit and the second gap adjusting unit or, even if the there is some shift, the amount of shift in the gap is small. Therefore, tilting of the recording head with respect to the support face supporting the recording medium is eliminated, or even if there is some tilting, the tilting falls within an allowable range of tilting of the recording head with respect to the support face. In so doing, there is no concern of the recording quality to the recording medium being decreased, or there is little concern.

In addition, since the synchronization unit is provided on the carriage, there is no need for both ends in the first gap adjusting unit and the second gap adjusting unit to be abutted on the abutting portions provided on the first guide member and the second guide member by protruding from the carriage.

Therefore, since it is not easy for the user to touch the synchronization unit, it is difficult for shifting of the gap in the first gap adjusting unit, the second gap adjusting unit and the synchronization unit to occur. In addition, during a paper jam, it is also difficult for shifting of the gap by the paper touching the first gap adjusting unit, the second gap adjusting unit and the synchronization unit. Accordingly, the recording apparatus of the present aspect is able to prevent the occurrence of a gap shift between the first gap adjusting unit and the second gap adjusting unit.

According to a second aspect of the invention, it is preferable that the first gap adjusting unit and the second gap adjusting unit each include a rack; and the synchronization unit include transfer gears engaging with each rack, and pinion gears engaging with each transfer gear.

The apparatus according to the second aspect, in addition to the same operation effects as the first aspect, is able to cause synchronization between the first gap adjusting unit and the second gap adjusting unit since the motion of the first gap adjusting unit is reliably transferred to the rack of the second gap adjusting unit by the transfer gear and the pinion gear engaging with the rack of the first gap adjusting unit, and converted to the motion of the second gap adjusting unit.

According to a third aspect of the invention, it is preferable to further include a switching member able to advance and retreat with respect to the movement region of the first gap adjusting unit accompanying the movement operation of the carriage, engaging with the first gap adjusting unit by advancing to the movement region, and causing the first gap adjusting unit to execute gap switching, and the engaging position of the switching member and the first gap adjusting unit is positioned in the housing of the carriage in the scanning direction.

The apparatus according to the third aspect, in addition to the same operation effects as the first and second aspects, is able to prevent paper touching the engaging position due to a paper jam or a user unintentionally touching the engaging position since the engaging position of the switching member and the first gap adjusting unit is positioned inside the housing of the carriage in the scanning direction, and is able to reliably cause the first gap adjusting unit and the second gap adjusting unit to be synchronized by the synchronization unit.

According to a fourth aspect of the invention, it is preferable that the first gap adjusting unit include a first sliding member sliding with respect to the first guide member and a first cam member interposed between a portion of the housing and the first sliding member, and including a shape causing the housing of the carriage to displace in a direction changing the gap by relatively sliding in the scanning direction with respect to the housing and the first sliding member; the second gap adjusting unit include second sliding member sliding with respect to the second guide member and a second cam member interposed between a portion of the housing and the second sliding member, and having a shape causing the housing of the carriage to displace in a direction changing the gap by relatively sliding in the scanning direction with respect to the housing and the second sliding member; the first cam member and the second cam member include cam portions formed by arranging in an alternating step-shape a gap maintaining face maintaining the gap and a gap adjusting face causing the gap to change; and at least one of the plurality of gap maintaining faces the second cam member includes be formed with a length in the scanning direction longer than the corresponding gap maintaining face the first cam member includes.

The apparatus according to the fourth aspect, in addition to the same operation effects as the above aspects, is able to allow shifting in the scanning direction of the abutting position of each cam member and the housing of the carriage by delaying of the start of motion of the second gap adjusting unit with respect to the start of motion of the first gap adjusting unit due to torsion of the rotary axis or backlash of the gear in a case where the synchronization unit, for example, is configured to include a rotary axis, gear or the like, since the gap maintaining face of the second gap adjusting unit is formed longer than the gap maintaining face of the first gap adjusting unit.

More specifically, for example, during engaging of the gap maintaining face of the first cam member with the housing of the carriage in the first gap adjusting unit, it is possible to prevent defects such that the gap adjusting face of the second cam member engages with the housing of the carriage in the second gap adjusting unit, that is, the occurrence of a state where the gap does not achieve synchronization. As above, according to the aspect, it is possible to reliably cause the first gap adjusting unit and the second gap adjusting unit to be synchronized.

According to a fifth aspect of the invention, it is preferable that the position in the scanning direction of at least one of the plurality of gap maintaining faces the second cam member has be arranged with respect to the position of the corresponding gap maintaining face the first cam includes, and be shifted in a direction in which the slide operation of the second cam member delays with respect to the slide operation of the first cam member.

According to the aspect, in addition to the same operation effects of the fourth aspect, it is possible to allow shifting in the scanning direction of the abutting position of each gap adjusting unit and the housing of the carriage due to delay of the start of motion of the second gap adjusting unit with respect to the start of motion of the first gap adjusting unit, since the position in the scanning direction of the gap maintaining face of the second gap maintaining unit is arranged shifted in a direction delayed with respect to the slide operation of the first gap adjusting unit. That is, it is possible to obtain the same operation effects as the above-described fourth aspect, in other words, to reliably cause the first gap adjusting unit and the second gap adjusting unit to be synchronized.

According to a sixth aspect of the invention, it is preferable that the first gap adjusting unit include a first sliding member sliding with respect to the first guide member, a first cam member interposed between a portion of the housing and the first sliding member, and including a shape causing the housing of the carriage to displace in a direction changing the gap by relatively sliding in the scanning direction with respect to the housing and the first sliding member; a second gap adjusting unit include a second sliding member sliding with respect to the second guide member, a second cam member interposed between a portion of the housing and the second sliding member, and a shape causing the housing of the carriage to displace in a direction changing the gap by relatively sliding in the scanning direction with respect to the housing and the second sliding member, the first cam member and the second cam member include cam portions formed by arranging in an alternating step-shape a gap maintaining face maintaining the gap and a gap adjusting face causing the gap to change, and the position in the scanning direction of at least one of the plurality of gap maintaining face the second cam member includes be arranged shifted in a direction in which the slide operation of the second cam member delays with respect to the slide operation of the first cam member, with respect to the position of the corresponding gap maintaining face the first cam includes.

According to the aspect, in addition to the same operation effects as any of the first to third aspects, it is possible to obtain the same operation effects as the fifth aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

Below, embodiments of the invention are described based on the drawings. Moreover, because configurations in each embodiment have the same references applied thereto, description thereof will be made only in the first embodiment, and description of the configurations will not be repeated in subsequent embodiments.

Figure 1:
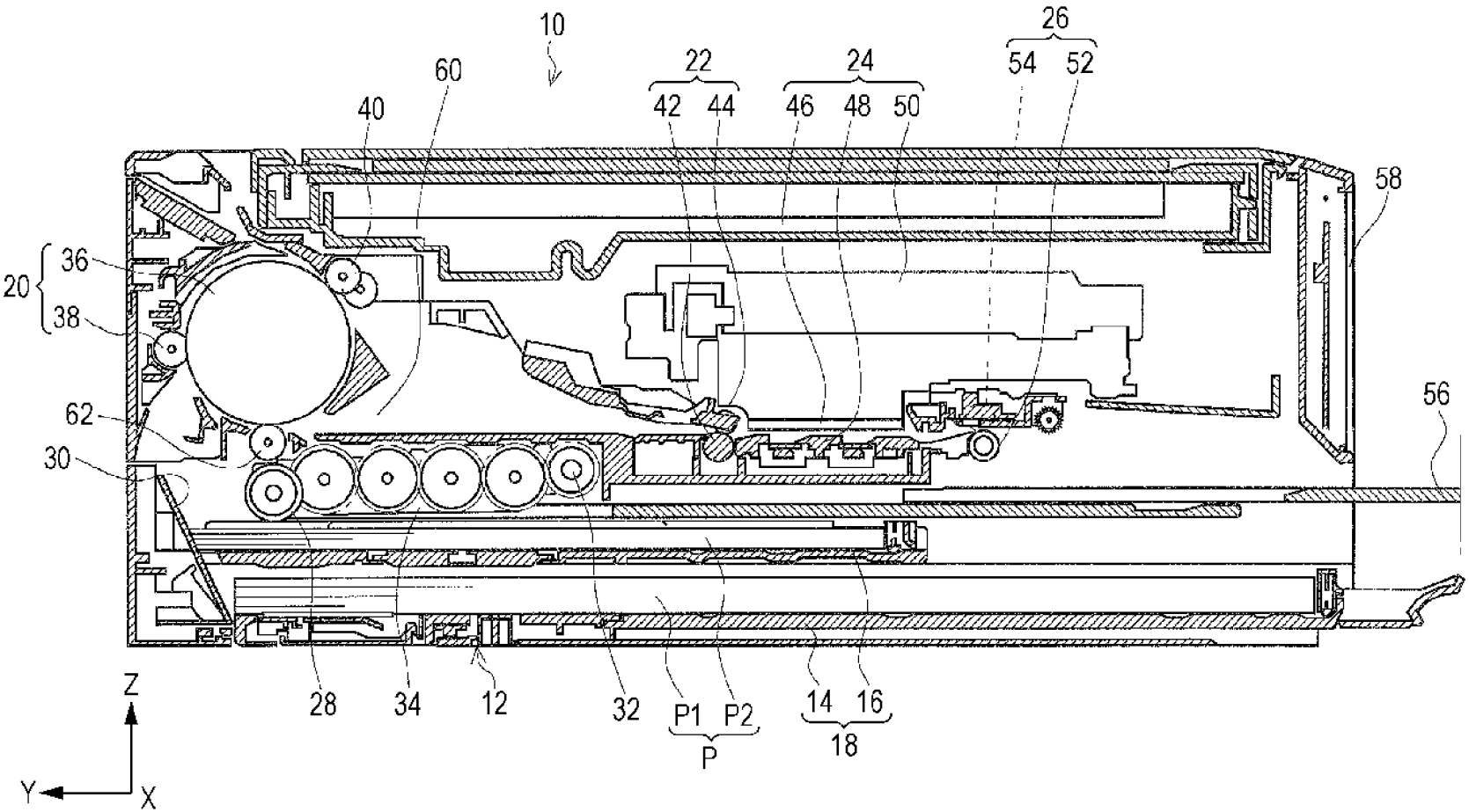
FIG. 1 is a side cross-sectional view showing a paper transport path of a printer according to the invention.
Figure 2:
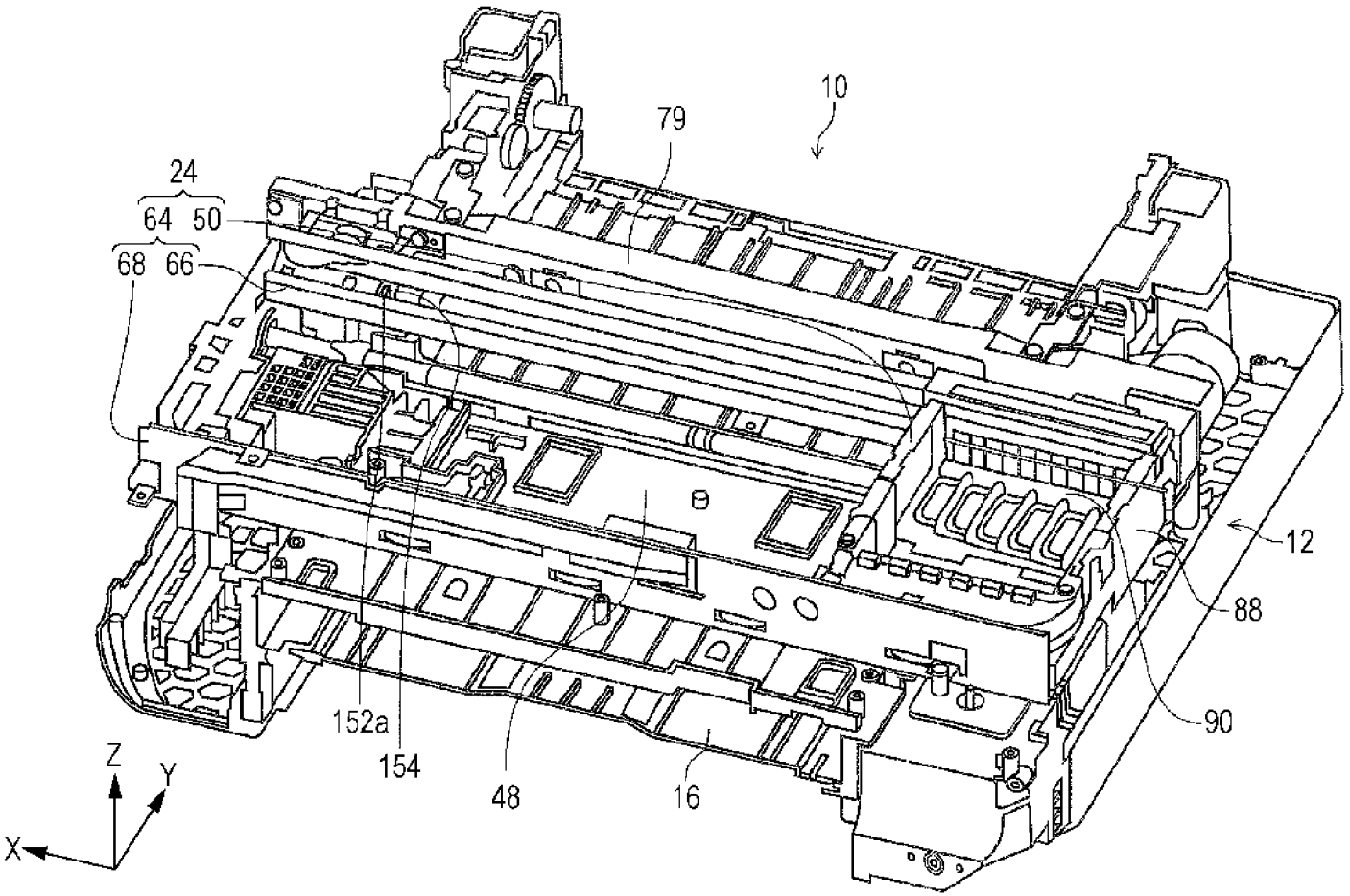
FIG. 2 is a perspective view of a printer according to the invention.
Figure 3:
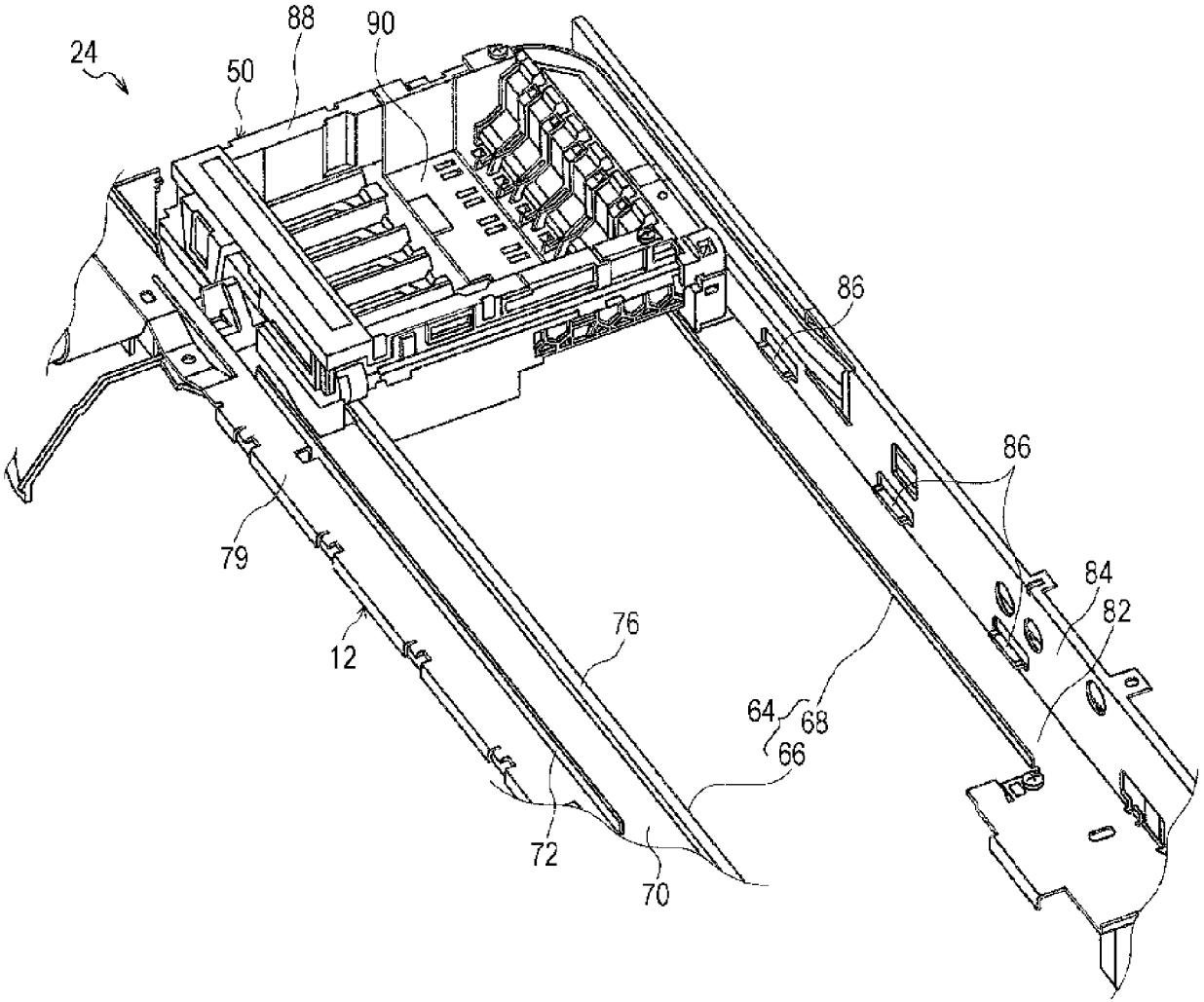
FIG. 3 is a perspective view of a carriage arranged on a guide rail.
Figure 4A:
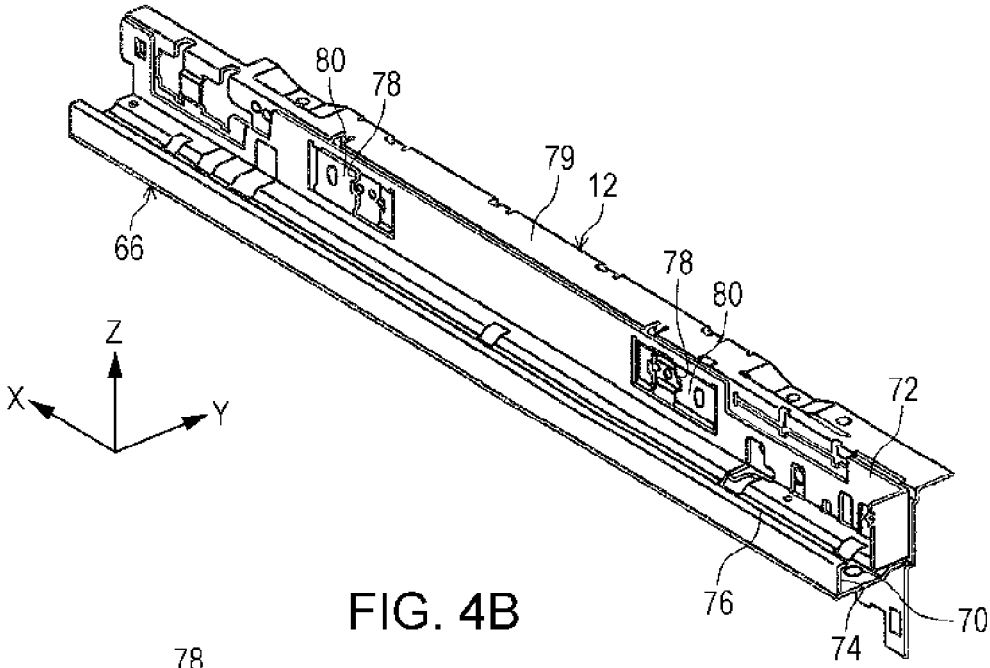
FIG. 4A is a perspective view of a main guide rail.
Figure 4B:
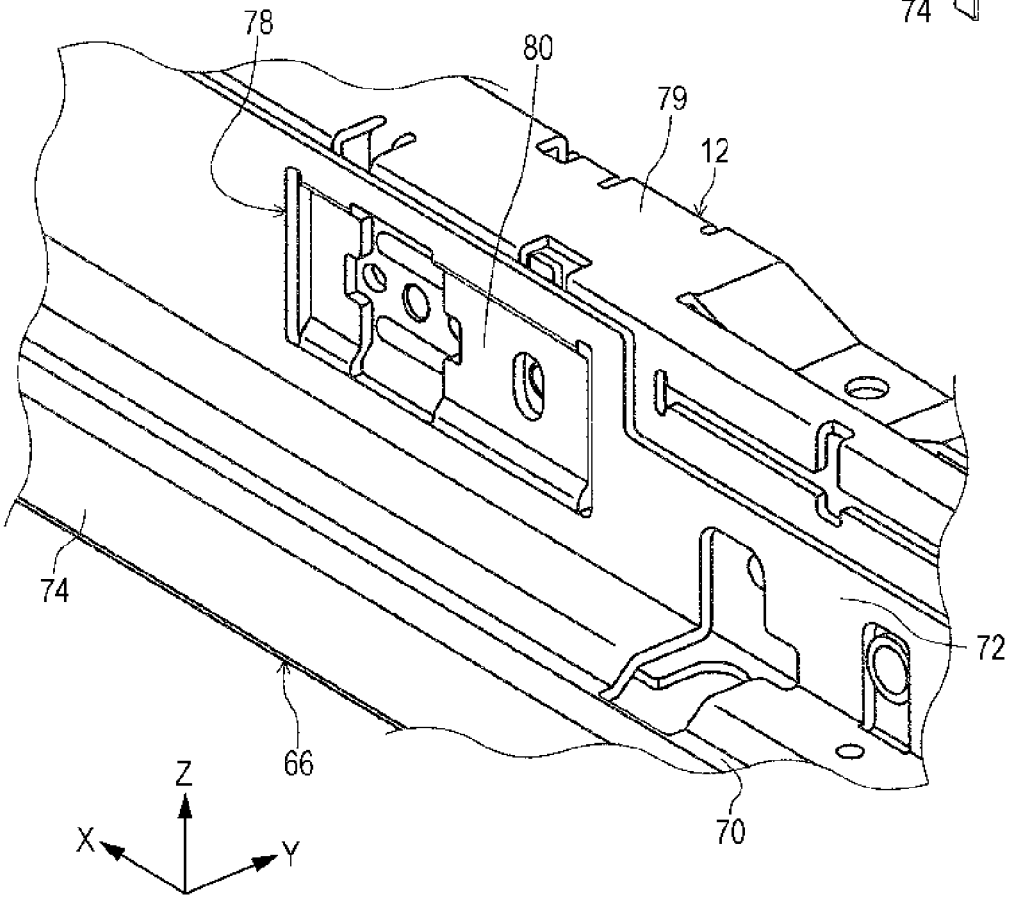
FIG. 4B is an enlarged perspective view of an attachment portion of a main guide rail.
Figure 5A:
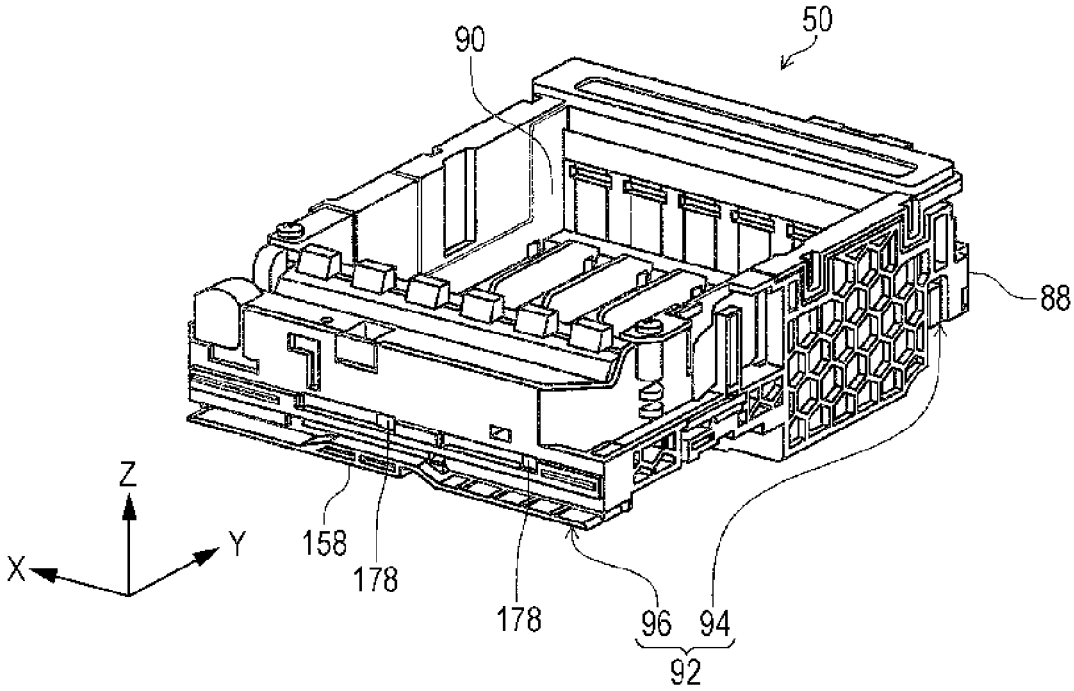
FIG. 5A is a perspective view of the housing of a carriage seen from the front.
Figure 5B:
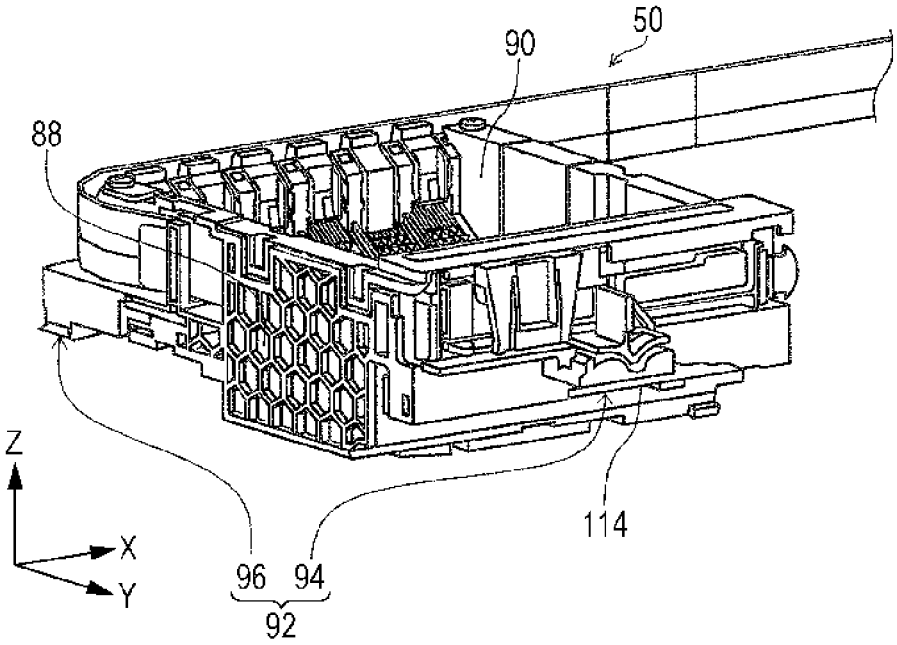
FIG. 5B is a perspective view of the housing of a carriage seen from the rear.

FIG. 1 is a side cross-sectional view showing a paper transport path of an ink jet printer (hereinafter, referred to as a "printer") 10, which is one embodiment of the "recording apparatus"; FIG. 2 is a perspective view of a printer according to the invention; FIG. 3 is a perspective view of a carriage arranged on a guide rail; FIG. 4A is a perspective view of a main guide rail; FIG. 4B is an enlarged perspective view of an attachment portion of a main guide rail; FIG. 5A is a perspective view of a housing of a carriage seen from the front; and FIG. 5B is a perspective view of a housing of a carriage seen from the rear.

Figure 6:
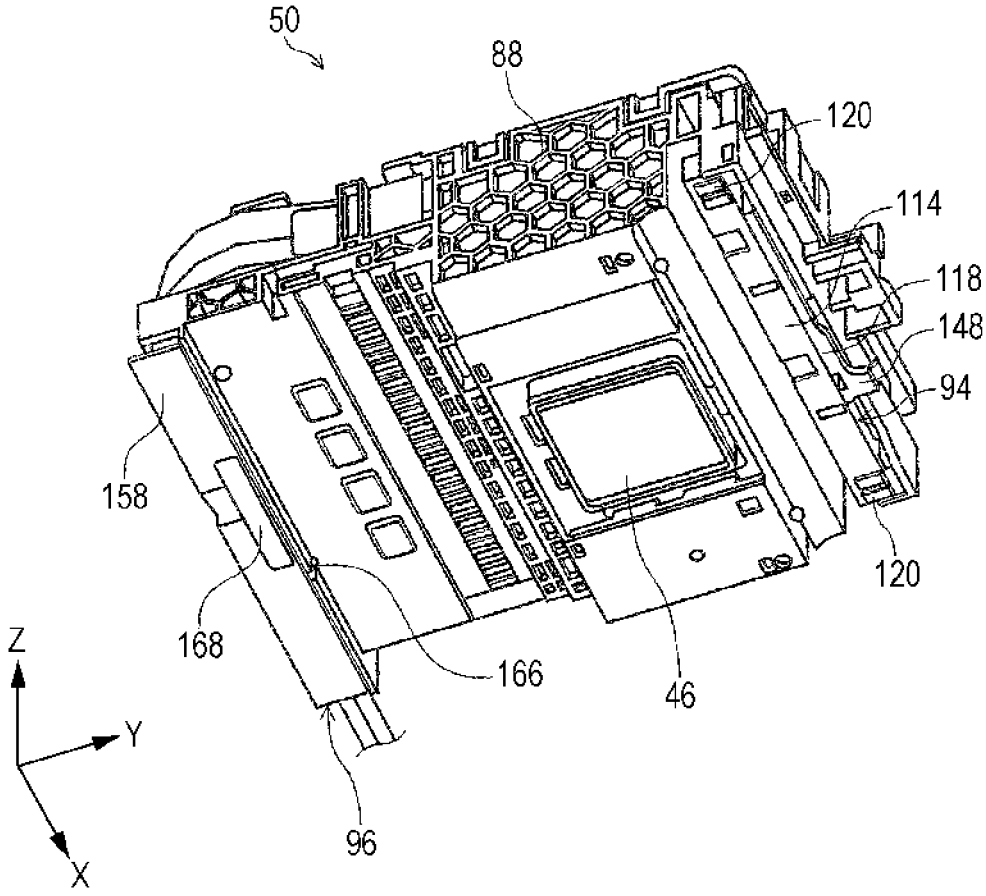
FIG. 6 is a perspective view of the housing of a carriage seen from the bottom face side.
Figure 7:
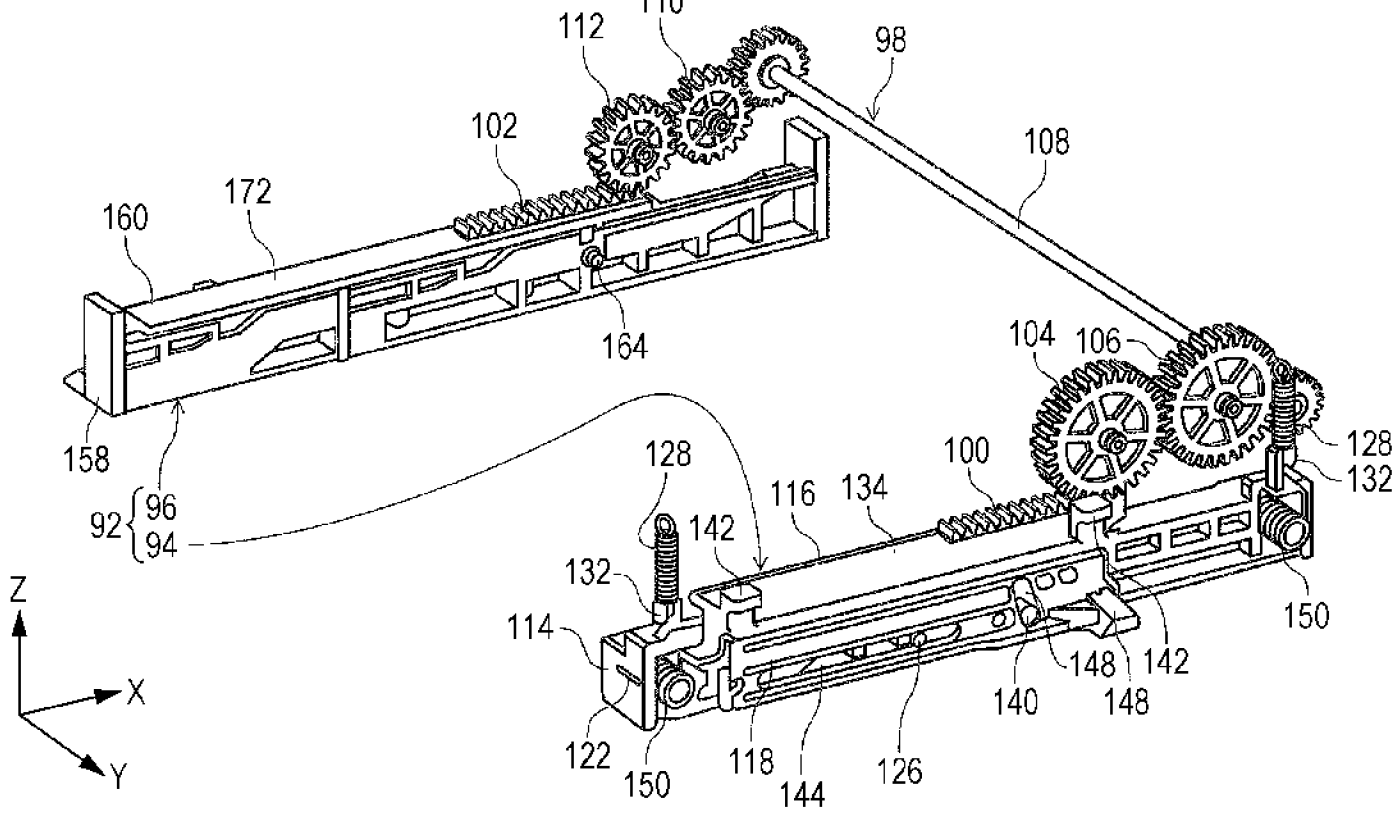
FIG. 7 is a perspective view of a gap adjusting unit.
Figure 8A:
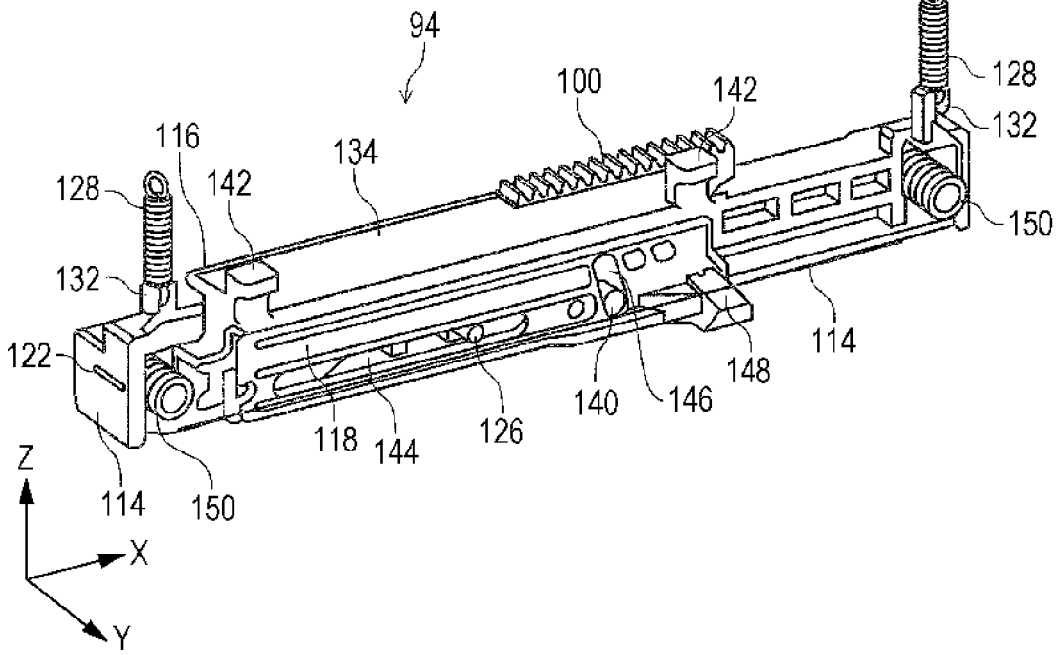
FIG. 8A is a perspective view of main gap adjusting unit.
Figure 8B:
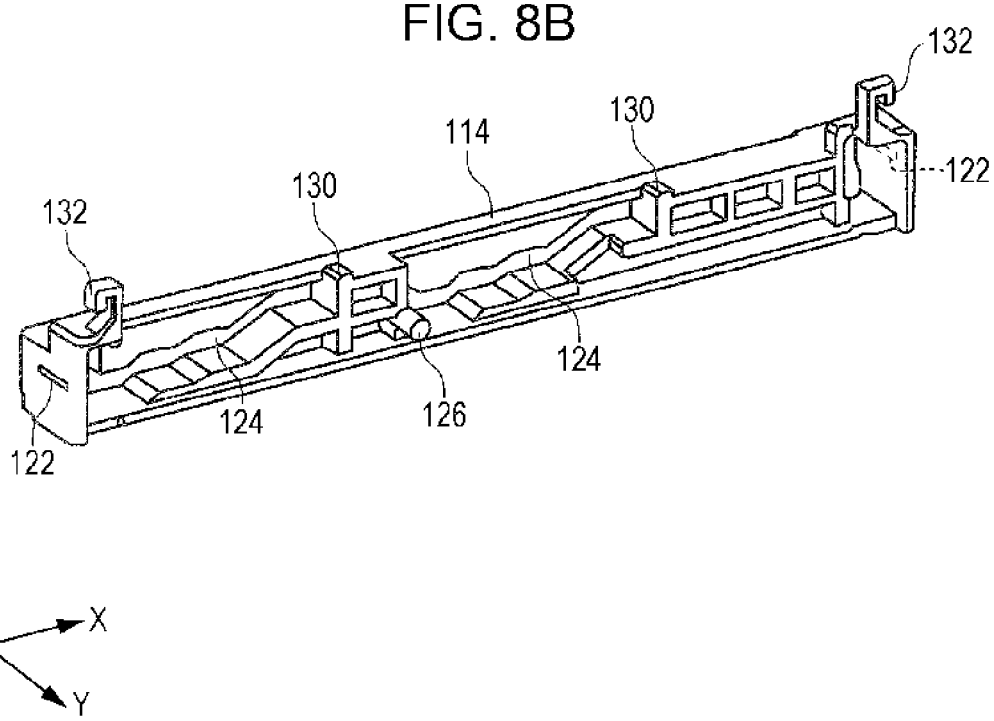
FIG. 8B is a perspective view of a sliding member of a main gap adjusting unit.
Figure 9A:
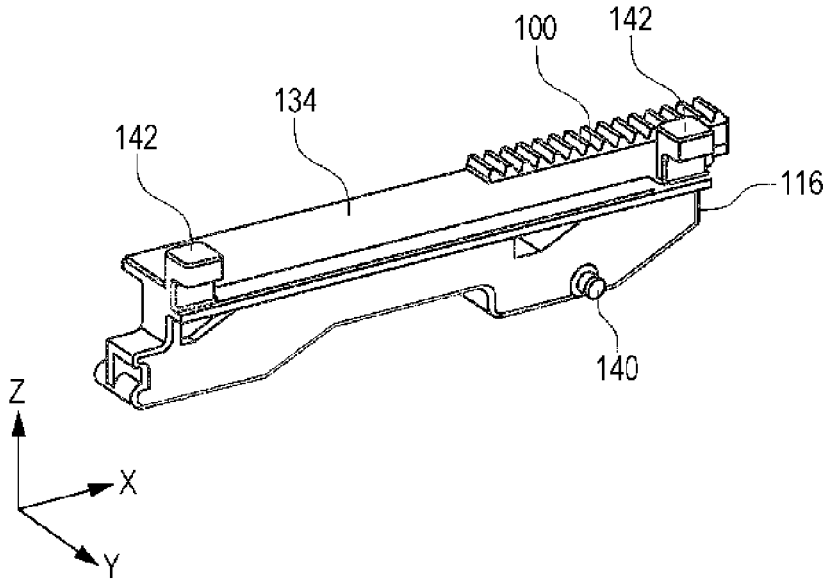
FIG. 9A is a perspective view of a cam member of a main gap adjusting unit.
Figure 9B:
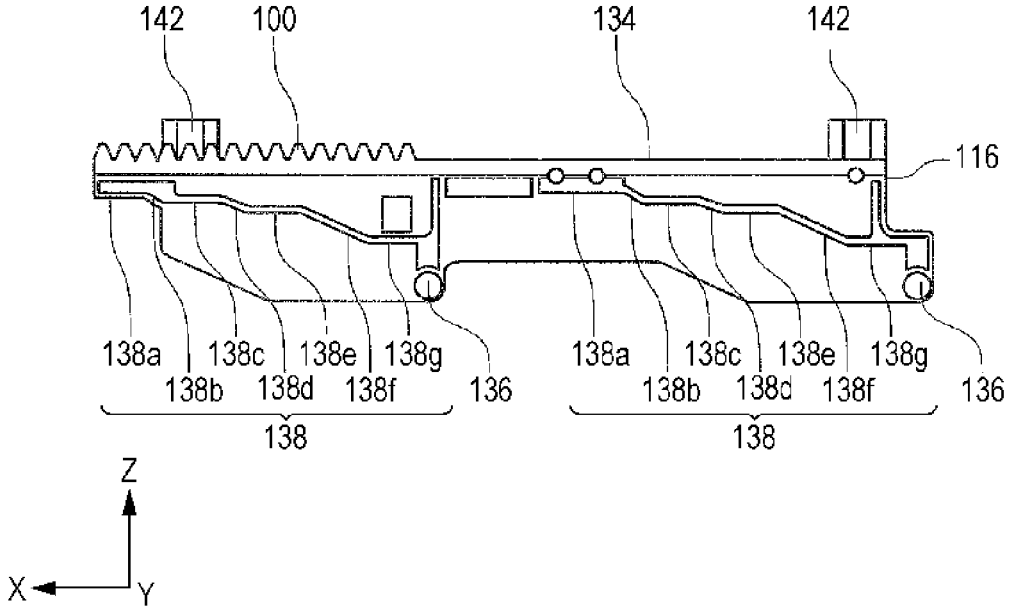
FIG. 9B is a front view of a cam member of a main gap adjusting unit.
Figure 10:
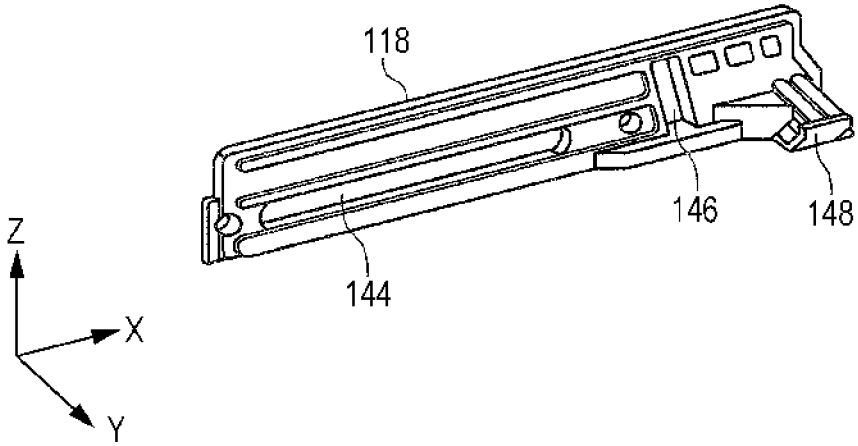
FIG. 10 is a perspective view of an engaging member of a main gap adjusting unit.
Figure 11:
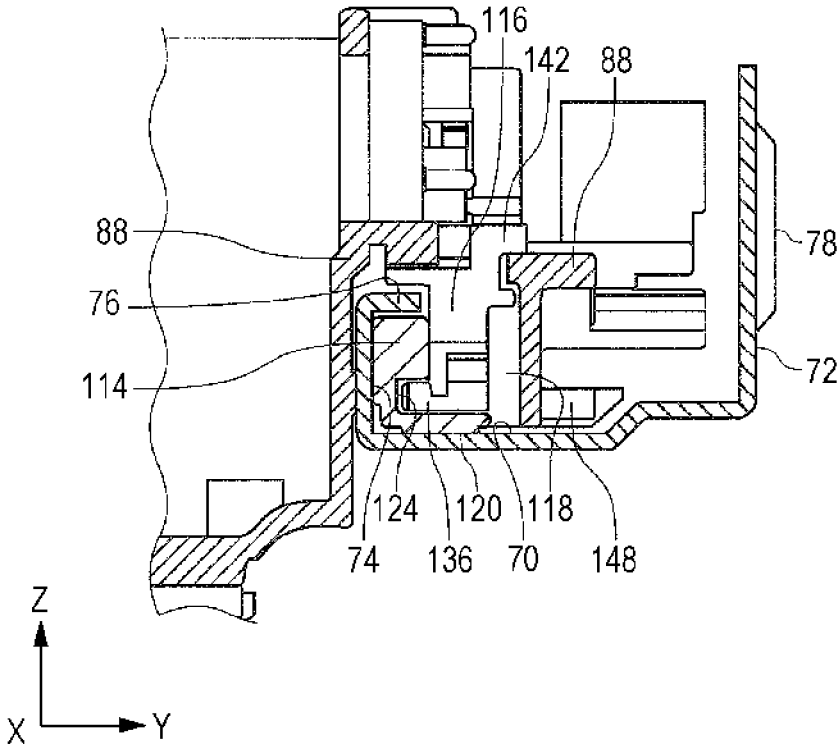
FIG. 11 is a cross-sectional view in the Y-axis direction of the main gap adjusting unit in FIG. 8A.

In addition, FIG. 6 is a perspective view of the housing of a carriage seen from the bottom face side; FIG. 7 is a perspective view of a gap adjusting unit; FIG. 8A is a perspective view of a main gap adjusting unit; FIG. 8B is a perspective view of a sliding member of a main gap adjusting unit; FIG. 9A is a perspective view of a cam member of a main gap adjusting unit; FIG. 9B is a front view of a cam member of a main gap adjusting unit; FIG. 10 is a perspective view of an engaging member of a main gap adjusting unit; and FIG. 11 is a cross-sectional view of a main gap adjusting unit in the Y-axis direction in FIG. 8A.

Figure 12:
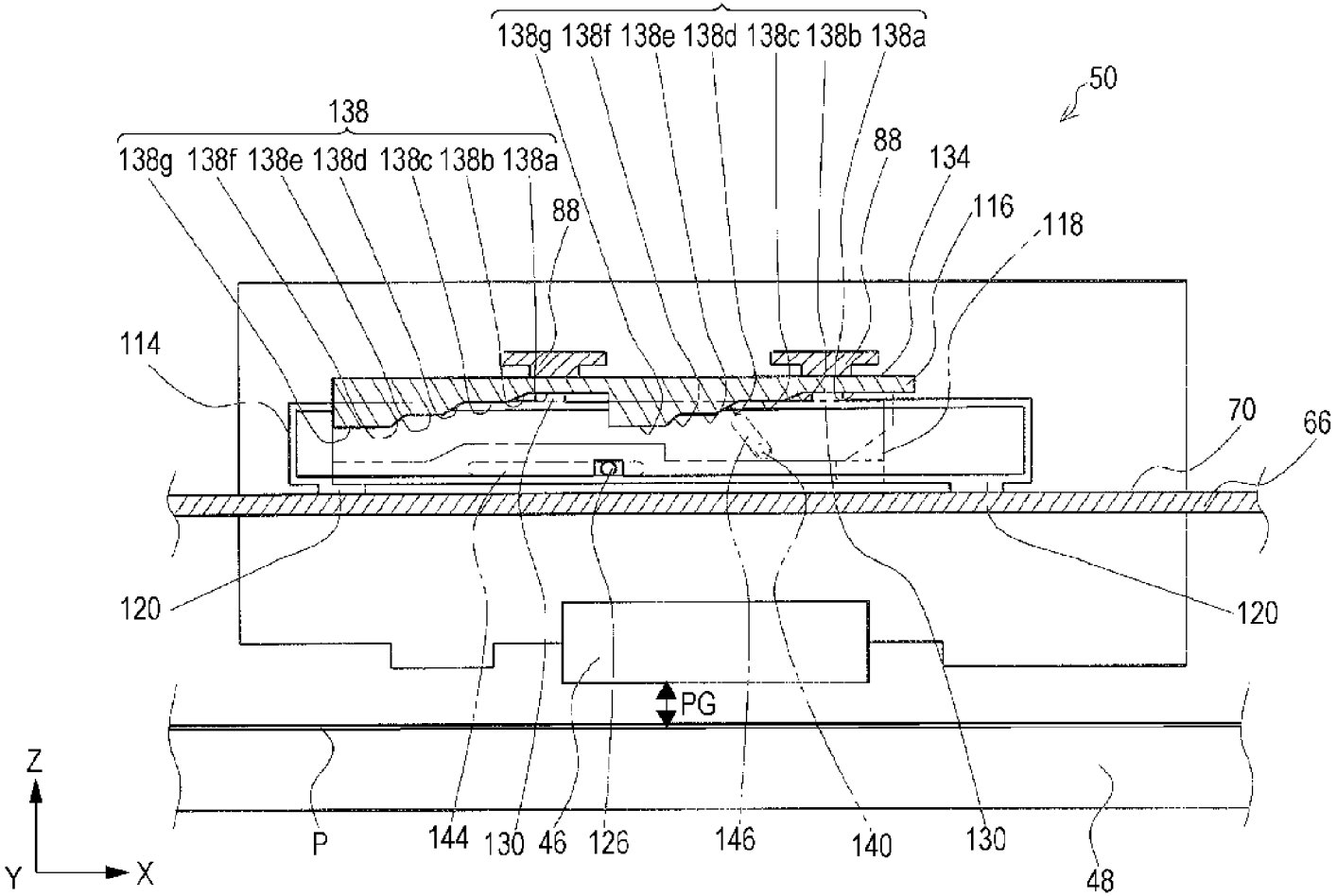
FIG. 12 is an explanatory diagram of a gap adjustment.
Figure 13:
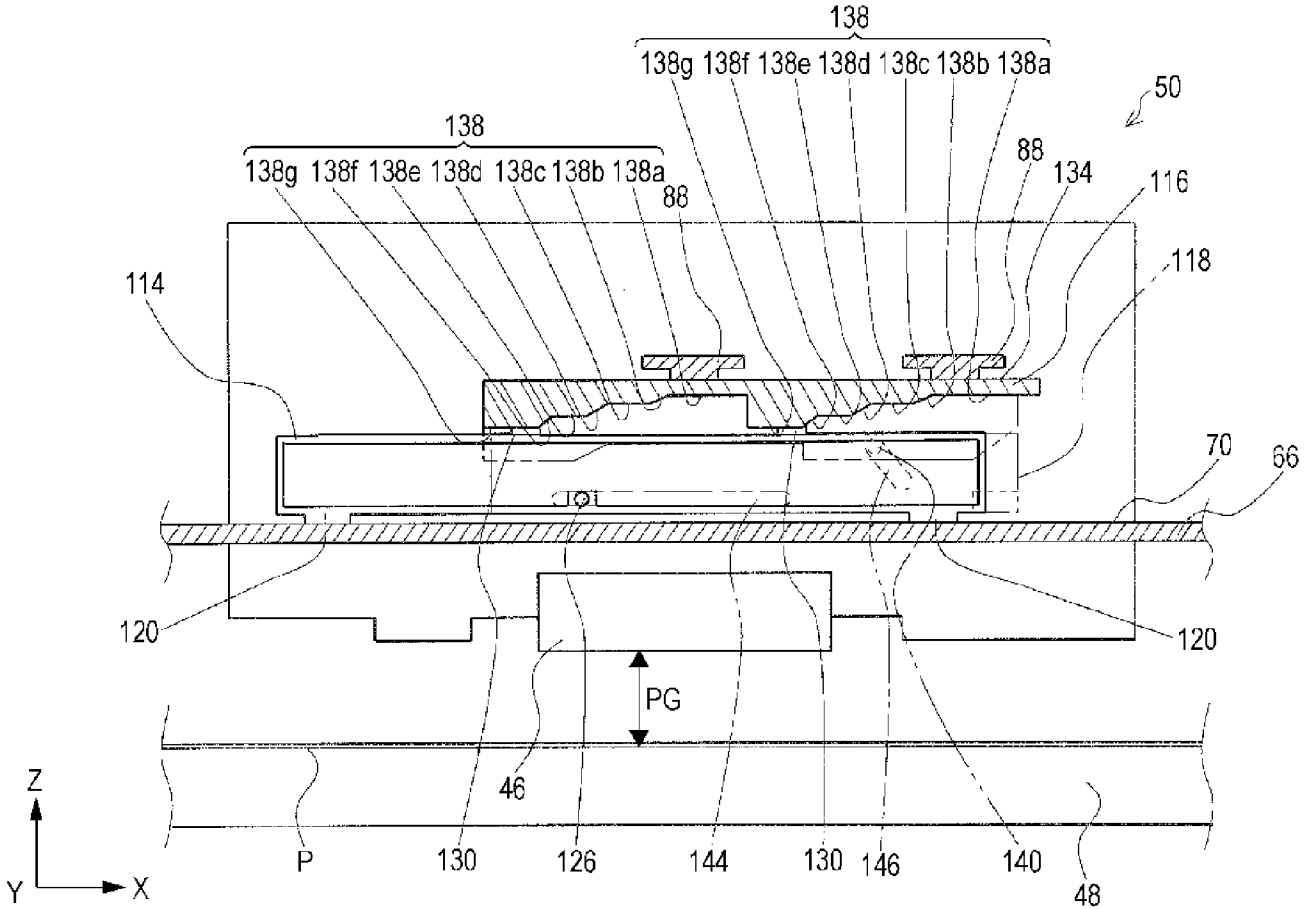
FIG. 13 is an explanatory diagram of a gap adjustment.
Figure 14:
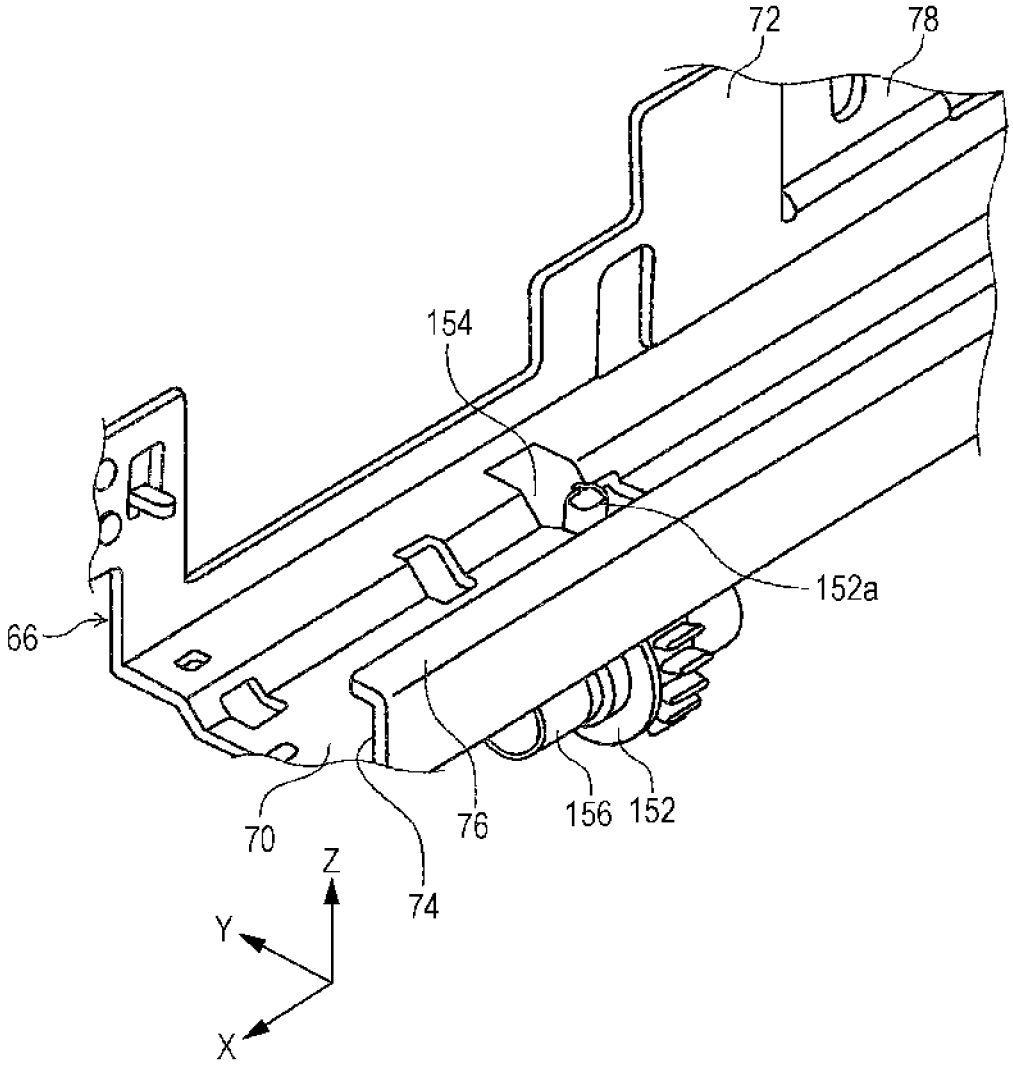
FIG. 14 is perspective view of a switching lever portion.
Figure 15A:
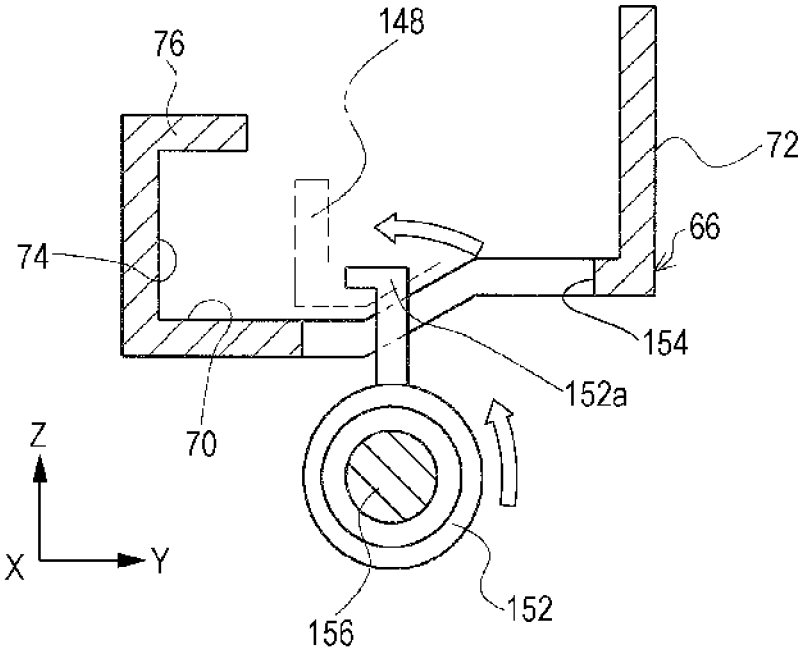
FIG. 15A is an explanatory diagram during advancing of a switching lever in the movement region of the engaging member.
Figure 15B:
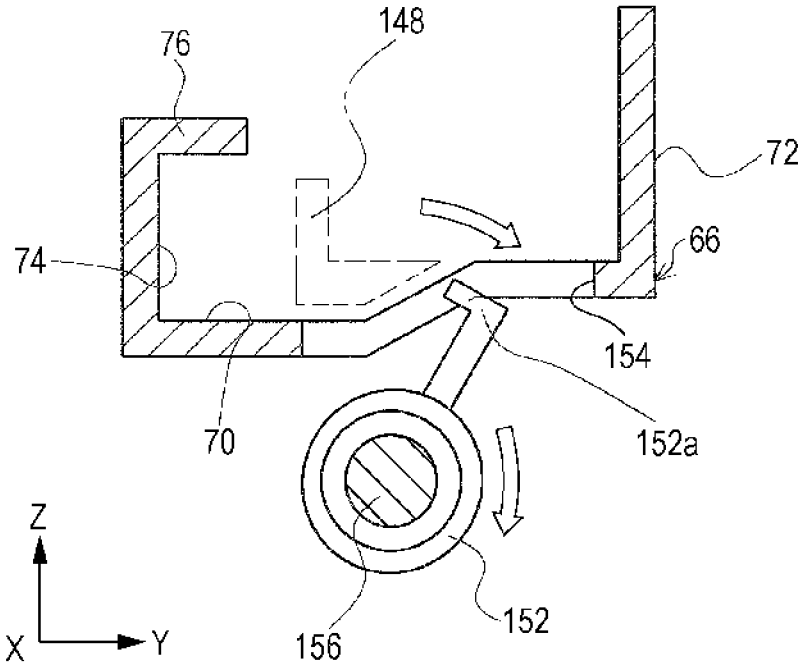
FIG. 15B is an explanatory diagram of during retreating of a switching lever in the movement region of the engaging member.

FIGS. 12 and 13 are explanatory diagrams of gap adjustment; FIG. 14 is a perspective view of a switching lever portion; FIG. 15A is an explanatory diagram during advancing of a switching lever in the movement region of the engaging member; and FIG. 15B is an explanatory diagram of during retreating of a switching lever in the movement region of the engaging member.

Figure 16A:
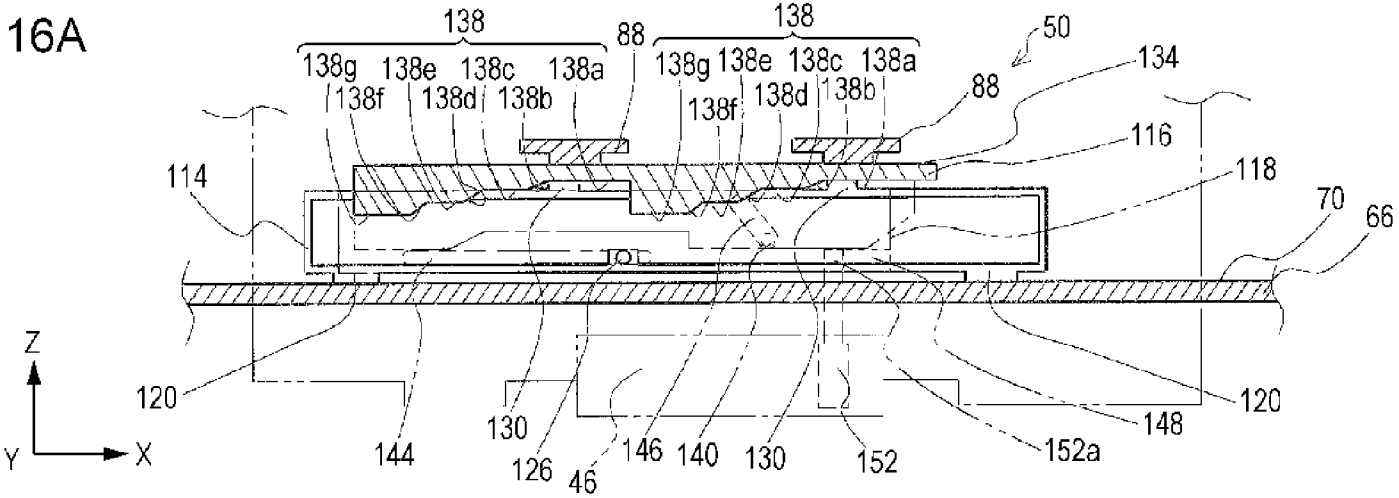
FIGS. 16A and 16B are diagrams describing the operation when increasing the size of the gap.
Figure 16B:
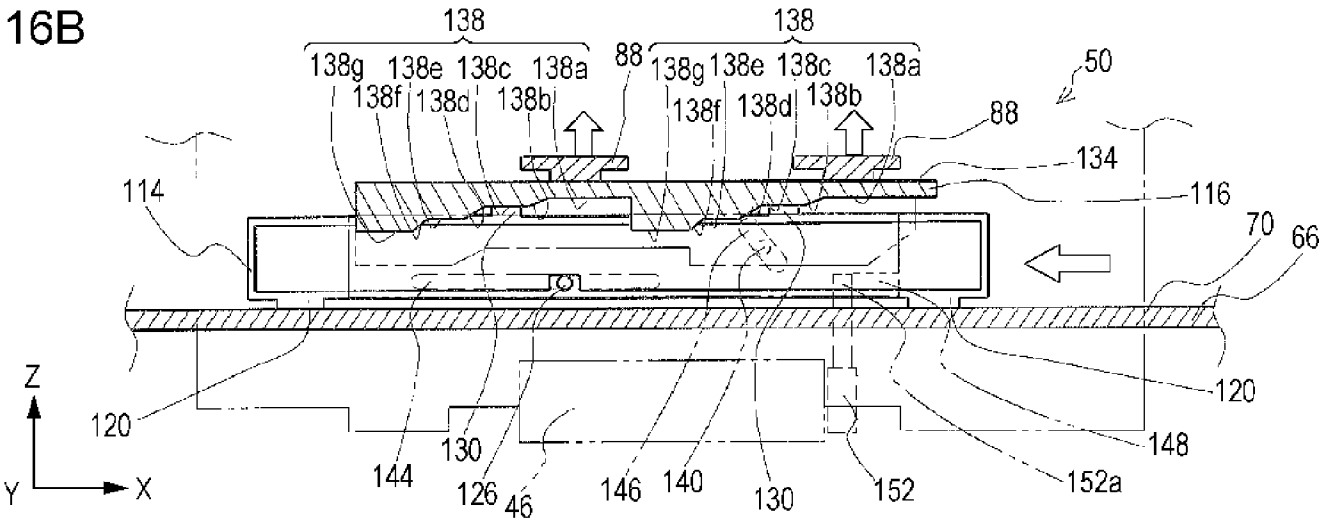
Figure 17A:
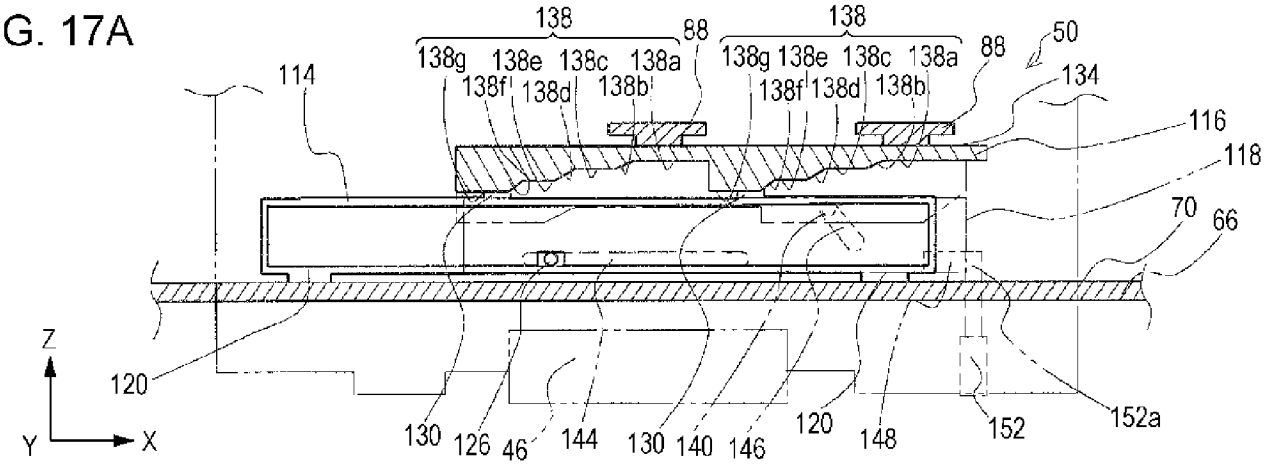
FIGS. 17A and 17B are diagrams describing the operation when decreasing the size of the gap.
Figure 17B:
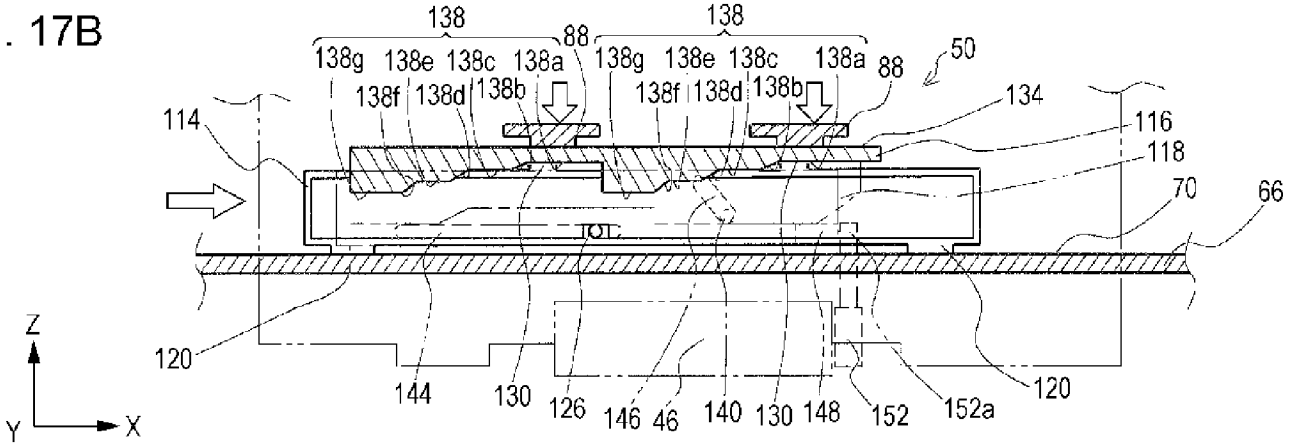
Figure 18A:
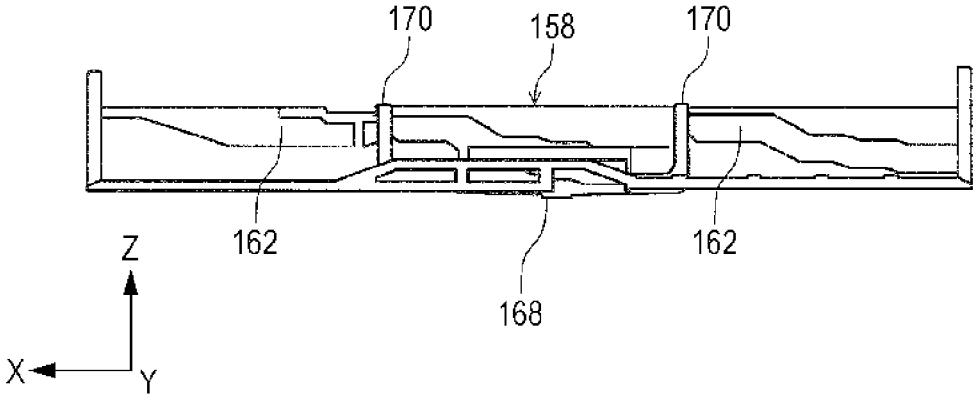
FIG. 18A is a front view of a sliding member of a sub-gap adjusting unit.

In addition, FIGS. 16A and 16B are diagrams describing an operation when a gap is increased; FIGS. 17A and 17B are diagrams describing an operation when a gap is decreased; and FIGS. 18A is a front view of a sliding member of a sub-gap adjusting unit, 18B is a rear view of a sliding member of a sub-gap adjusting unit.

Figure 19A:
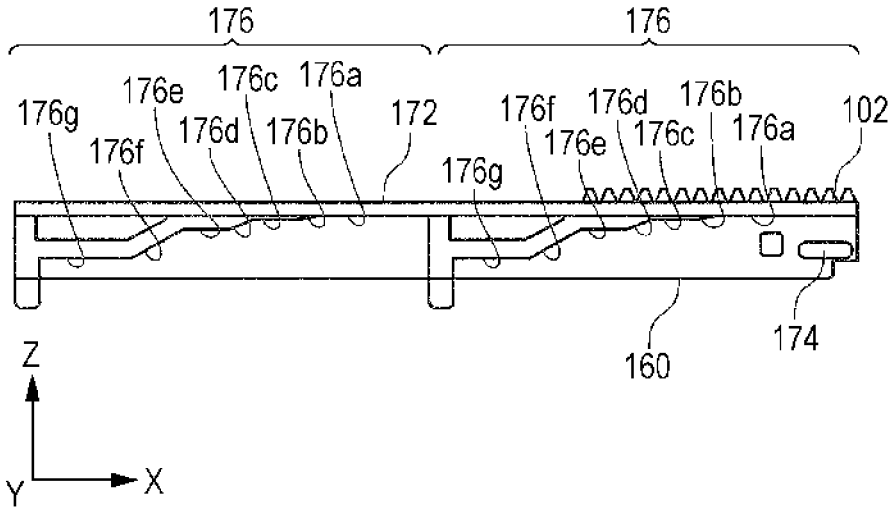
FIG. 19A is a rear view of a cam member of a sub-gap adjusting unit.
Figure 19B:
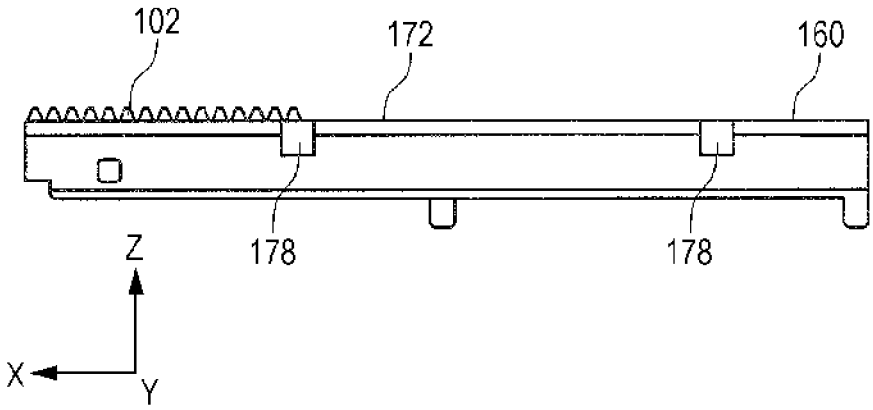
FIG. 19B is a front view of a cam member of a sub-gap adjusting unit.
Figure 20A:
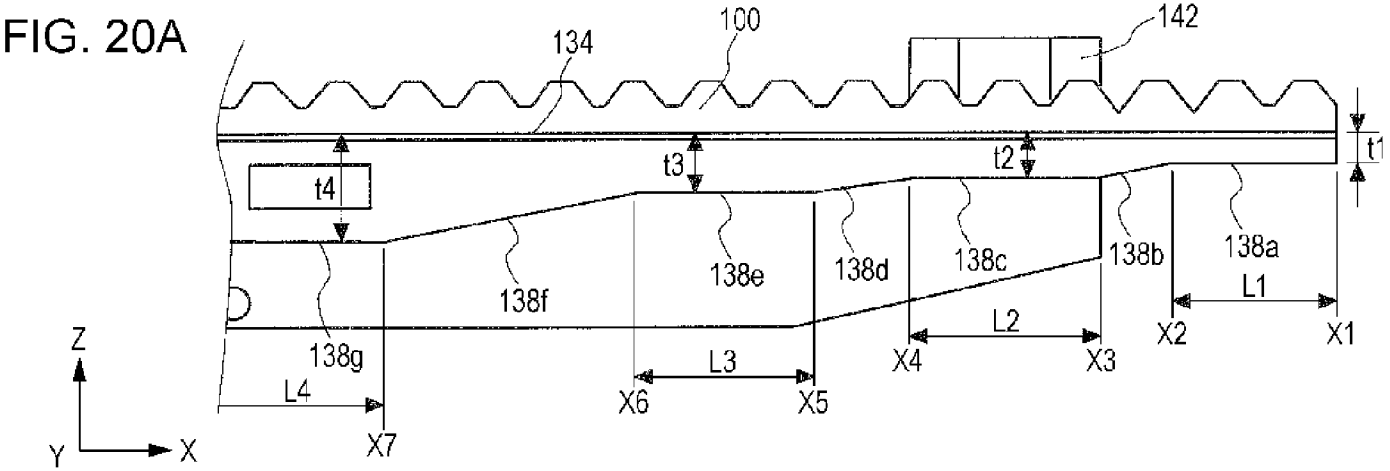
FIG. 20A is an enlarged view of a cam of a cam member of a main gap adjusting unit.
Figure 20B:
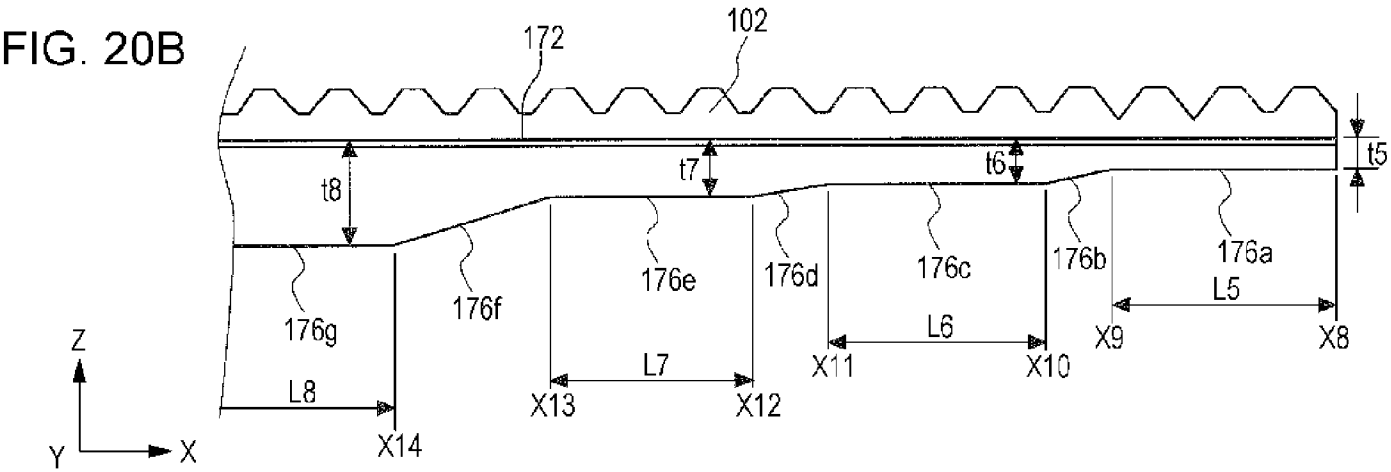
FIG. 20B is an enlarged view of a cam of a cam member of a sub-gap adjusting unit.
Figure 21:
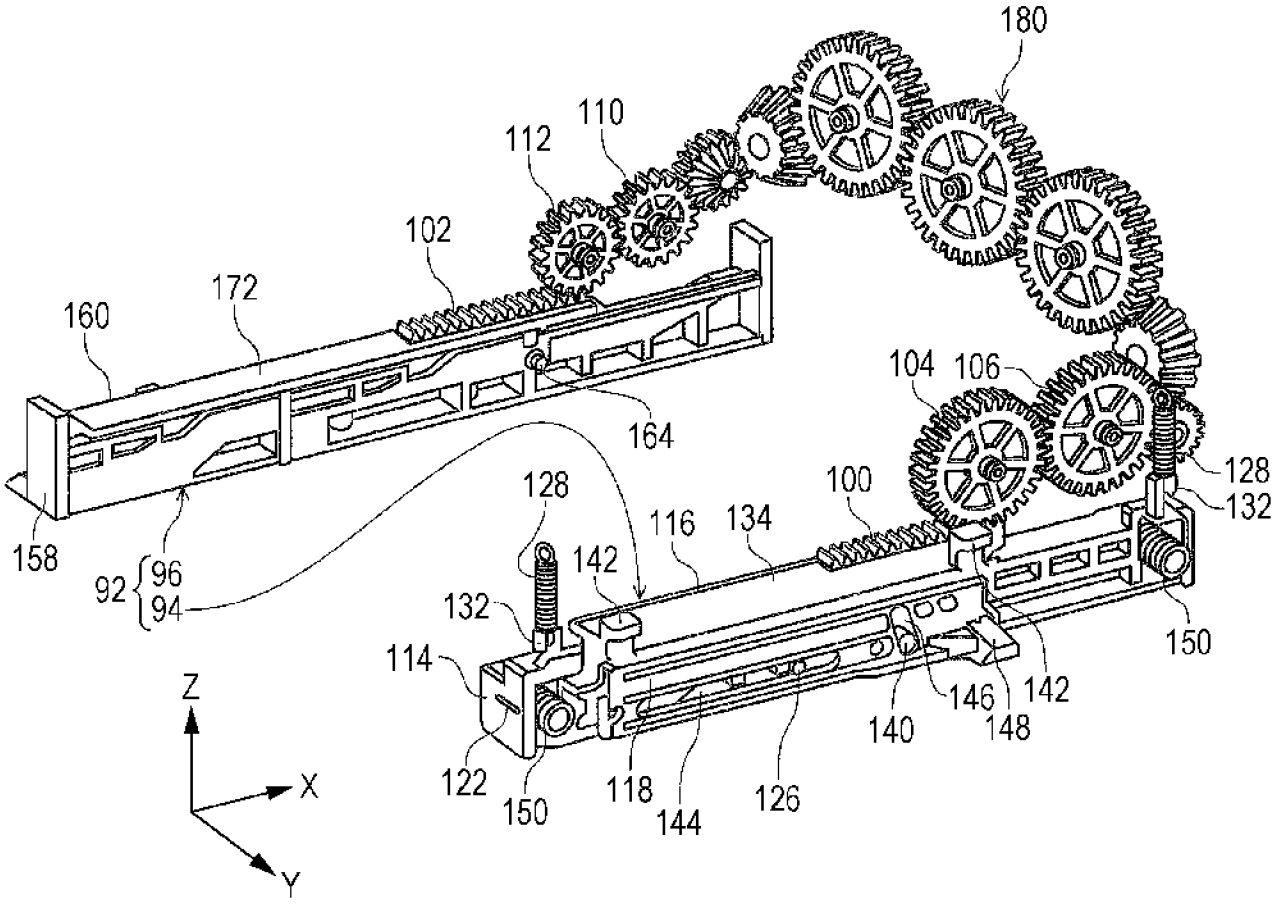
FIG. 21 is a perspective view of a gap adjusting mechanism according to a second embodiment of the invention.

FIG. 19A is a rear view of a cam member of a sub-gap adjusting unit; FIG. 19B is a front view of a cam member of a sub-gap adjusting unit; FIG. 20A is an enlarged view of a cam of a cam member of a main gap adjusting unit; FIG. 20B is an enlarged view of a cam of a cam member of a sub-gap adjusting unit; and FIG. 21 is a perspective view of a second embodiment of a gap adjusting mechanism.

Moreover, in FIG. 1 almost all of the rollers are depicted in the same plane in order to show the rollers arranged on the paper transport path of the printer 10; however, the positions in the depth direction thereof (front to back direction from the surface of the paper in FIG. 1) are not necessarily limited to matching (there are cases in which they match). In addition, for the X-Y-Z coordinate system shown in each drawing, the X direction indicates the scanning direction of the recording head, the Y direction the depth direction of the recording apparatus, and the Z direction the direction changing the gap, that is, the height direction of the apparatus. Moreover, the −Y direction in each drawing is defined as the front face side of the apparatus, and the +Y direction side is defined as the rear face side of the apparatus.

Below, the constituent elements of on the paper transport path will be described in further detail with reference to FIG. 1. The apparatus main body 12 is configured including a feeding portion 18 configured including a lower tray 14 accommodating paper and an upper tray 16 accommodating paper as a "recording medium" and positioned on the upper side of the lower tray 14; a feeding unit 20, a transport unit 22, a recording unit 24 and a discharge unit 26. The lower tray 14 and upper tray 16 are each configured to be attachable and detachable from the front side of the apparatus with respect to the apparatus main body 12. In addition, the feeding portion 18 further includes a pick-up roller 28 and a separation unit 30.

In addition, the upper tray 16 is driven by a motor not shown in the drawings in the apparatus depth direction (FIG. 1, Y-axis direction), and is configured to be movable between an end position, that is a feedable position (refer to FIG. 1), and a retreated position (not shown) displaced by a predetermined amount in the −Y direction from the end position. Moreover, in FIG. 1, paper accommodated in the lower tray 14 and paper accommodated in the upper tray 16 are shown with the references P1 and P2 respectively (in cases where there is no particular need to distinguish therebetween, referred to as "paper P"). Moreover, the paper P is one example of a transported medium.

Above each tray, a pick-up roller 28 driven to rotate by a motor not shown in the drawings is provided. The pick-up roller 28 is provided on a swing member 34 swinging with a swing shaft 32 as a center. The pick-up roller 28 sends out the uppermost paper P2 to the feed path from the upper tray 16 by rotating in contact with the uppermost paper P2 accommodated in the upper tray 16, in cases where the upper tray 16 is in the feedable position.

The pick-up roller 28 sends out the uppermost paper P1 to the feed path from the lower tray 14 by rotating in contact with the uppermost paper P1 accommodated in the lower tray 14, in cases where the upper tray 16 is in the retreated position.

In addition, a separation unit 30 is provided at a position where the leading edge of the paper P1 accommodated in the lower tray 14 and the leading edge of the paper P2 accommodated in the upper tray 16 are opposed. The separation unit 30 contacts the leading edge of the paper P delivered by the rotation of the pick-up roller 28 from the lower tray 14 or the upper tray 16, and performs separation of the uppermost paper P and subsequent papers P by the paper P being transported to the downstream side of the feed path in a state contacting the separation unit 30. In so doing, the feeding unit 20 sends out a sheet material (paper P) which is one example of a transported medium to the downstream side of the feed path.

A feeding unit 20 is provided on the downstream side of the feed path of the separation unit 30. The feeding unit 20 includes a feed driving roller 36 driven by a motor not shown in the drawings, a separation roller 38 and a feed driven roller 40. The separation roller 38 again performs separation with respect to the paper P along with contacting the feed driving roller 36, and reliably sends only the uppermost paper P to the downstream side of the feed path.

In addition, a feed driven roller 40 driven to rotate by pinching a paper P between itself and a feed driving roller 36 is provided on the downstream side of the separation roller 38. Furthermore, a transport unit 22 including a transport driving roller 42 driven by a motor not shown in the drawings, and a transport driven roller 44 driven to rotate by pressing contact with the transport driving roller is provided on the downstream side of the feed path of the feed driven roller 40. The paper P is further sent to the downstream side by the transport unit 22.

A recording unit 24 is provided on the downstream side of the transport unit 22. The recording unit 24 includes a recording head 46, and a lower guide member as a support portion supporting the paper P and opposed to the recording head, that is, a platen 48. The recording head 46 is provided on the bottom portion of the carriage 50, and opposed to the paper P. The carriage 50 is driven so as to move reciprocally in the main scanning direction (front to back direction of the surface of paper in FIG. 1, that is, the X-axis direction) by a driving motor not shown in the drawings.

The lower guide member 48 supports the paper P, and regulates the distance between the lower guide member 48 and the recording head 46, that is, a gap PG. Also, a discharge unit 26 sending out paper P on which recording is performed is provided on the downstream side of the lower guide member 48. The discharge unit 26 includes a first roller 52 driven by a driving source not shown in the drawings, and a second roller 54 driven to rotate by contact with the first roller.

The paper P on which recording is performed by the recording unit 24 is pinched between a first roller 52 and a second roller 54 and is discharged to a discharge stacker 56 provided on the front face side (to the right in FIG. 1) of the apparatus main body 12. Moreover, the discharge stacker 56 is configured to be switchable between a state displacing in a direction protruding to the outer side of the apparatus main body 12, that is, being withdrawn along the Y-axis direction, and a state displacing in a direction being drawn into the inside of the apparatus main body 12, along with rotating with respect to the apparatus main body 12 of an operation panel portion 58.

In addition, in a case where recording is performed on both faces of the paper P in the printer 10, after recording is performed on a first face of the paper P by a recording unit 24, the side that is the trailing edge of the paper when recording is executed on the first face becomes the leading edge by a backward feed operation of the transport unit 22 and the discharge unit 26, and the paper P is returned to the upstream side of the transport unit 22. The paper P is further sent to an inversion path 60 by a backward feed operation of the transport unit 22. The paper P sent in the inversion path 60 is pinched by a driving roller 36 and an inverting roller 62, and is returned again to the feed path.

The paper P returned to the feed path is again sent to the transport unit 22 on the downstream side of the feed path by driving roller 36 by passing through the separation roller 38 and driven roller 40. At this time, the first face and second face of the paper P are subjected to curved inversion, and the second face opposes the recording head 46. The paper P is sent to the recording unit 24 by the transport unit 22. The paper P on which recording is performed on the second face by the recording unit 24 is pinched by the discharge unit 26, and discharged to the discharge stacker 56 provided on the front side of the apparatus.

First Embodiment

Furthermore, a recording unit 24 of a first embodiment according to the invention will be described in detail with reference to FIG. 2 and FIG. 3. The carriage 50 of the recording unit 24 moves in the scanning direction by being guided on a pair of guide rails 64 as a "guide member" extending in the scanning direction (X-axis direction of FIG. 2) of the recording head 46. The pair of guide rails 64 is configured by including a main guide rail 66 as a "first guide member" attached to the apparatus main body 12 on the rear face side of the apparatus, that is, the +Y direction side, and a sub-guide rail 68 as a "second guide member" attached to the apparatus main body 12 on the front face side of the apparatus, that is, the −Y direction side.

Referencing FIG. 4A and FIG. 4B, the main guide rail 66 is configured to include a sliding face 70, a support face 72 arranged upright in the Z direction from the end portion of the apparatus rear face side (Y direction side) of the sliding face 70, a guide face 74 as a wall face arranged upright in the Z direction from the end portion of the apparatus front face side (−Y direction side) of the sliding face 70, and a regulation portion 76 extending so as to oppose the sliding face 70 on the apparatus rear face side (Y direction side) from the upper end portion of the guide face 74.

A plurality of attachment portions 78 are provided at intervals in the scanning direction on the support face 72 of the main guide rail 66. The main guide rail 66 is attached by screws or the like in a state in which the attachment portions 78 contact the frame 79 of the apparatus main body 12 side. Moreover, flat faces 80 are formed on the attachment portions 78. The flat face 80 is formed so that the region of the flat face 80 on the support face 72 increases in order to reduce or prevent tilting in the height direction of the apparatus and torsion in the scanning direction in the main guide rail 66.

Again referencing FIG. 3, the sub-guide rail 68 is configured to include a sliding face 82, a wall face 84 arranged upright in the Z direction from the end portion of the apparatus front face side (−Y direction side) of the sliding face 82, and a plurality of eave-shaped portions 86 provided at intervals in the scanning direction along with protruding towards the carriage 50 from the wall face 84.

Each eave-shaped portion 86 engages with the front face of the carriage 50 accompanying the movement of the carriage 50 in the scanning direction, and prevents floating in the Z direction of the carriage 50. In so doing, when a paper jam occurs in the printer 10, it is possible to prevent the carriage 50 being lifted up in the +Z direction by the jammed paper and remaining displaced upward. Therefore, the printer 10 is able to quickly restart printing by eliminating the jammed paper in the printer 10.

The carriage 50 according to the first embodiment is shown with reference to FIG. 5A, FIG. 5B and FIG. 6. The carriage 50 includes a housing 88; an ink cartridge accommodation portion 90 provided on the upper portion of the housing 88 and accommodating a plurality of ink cartridges; a recording head 46 arranged so as to oppose the lower guide member 48 at the opening portion provided in the lower portion of the housing 88, and a gap adjusting unit 92 adjusting a gap PG between the recording head 46 and the lower guide member 48 supporting the paper P.

A gap adjusting unit 92 adjusting a gap between the recording head 46 and the lower guide member 48, that is, a gap PG, is arranged on the front face side (−Y side in FIG. 5A) and the rear face side (Y direction side in FIG. 5B) of the housing 88. The gap adjusting unit 92 is described in detail later; however, a main gap adjusting unit 94 as a "first gap adjusting unit" is arranged on the rear face side (to the right in FIG. 6) of the housing 88, and a sub-gap adjusting unit 96 as a "second gap adjusting unit" is arranged on the front face side (to the left in FIG. 6) of the housing 88.

The main gap adjusting unit 94 arranged on the rear face side of the housing 88 is supported by the main guide rail 66 along with abutting the sliding face 70 of the main guide rail 66. The sub-gap adjusting unit 96 arranged on the front face side of the housing 88 is supported by sub-guide rail 68 along with abutting the sliding face 82 of the sub-guide rail 68. The carriage 50 is able to move in the scanning direction by the main gap adjusting unit 94 and the sub-gap adjusting unit 96 being slid on the sliding face 70 and the sliding face 82 respectively.

In addition, accompanying lengthening the gap between the main guide rail 66 and the guide rail 68, the carriage 50 becomes longer in a direction travelling straight in the scanning direction and it is possible to lengthen the ink cartridge accommodation portion 90. In so doing, even if the height direction of the carriage is restricted, it is possible to ensure the ink capacity of the ink cartridge.

In the carriage 50, the recording head 46 arranged on the lower portion of the housing 88 is arranged close to the main gap adjusting unit 94 in the Y-axis direction (refer to FIG. 6). Incidentally, there is a need to adjust the gap PG when the printer 10 is assembled. In the related art, if the gap PG is adjusted by moving either of the main guide rail 66 or the sub-guide rail 68 in the Z-axis direction, the recording head 46 tilts with respect to the paper P supported by the lower guide member 48, and the printing precision on the paper P lowers. Therefore, there was a need for adjusting the gap PG by moving both of the main guide rail 66 and the sub-guide rail 68 in the Z-axis direction.

In the present embodiment, since the recording head 46 is arranged close to the main gap adjusting unit 94 along with lengthening the gap between the main guide rail 66 and the sub-guide rail 68, even if the gap PG is adjusted by moving the main guide rail 66 in Z-axis direction, the tilting of the recording head 46 is falls within an allowable range of tilting enabling maintaining the printing precision, and it is possible to reduce the influence on the printing precision on the paper P. Therefore, there is no need for adjusting the gap PG by moving the sub-guide rail 68 in the Z-axis direction, and it is possible to achieve simplification of the assembly process.

The gap adjusting unit 92 will be described in further detail with reference to FIG. 7. The gap adjusting unit 92 is configured to include a main gap adjusting unit 94 arranged on the rear face side in the housing 88 of the carriage 50, a sub-gap adjusting unit 96 arranged on the front face side of the housing 88 of the carriage 50, and a synchronization unit 98 causing the main gap adjusting unit 94 and sub-gap adjusting unit 96 to be synchronized.

A rack 100 displacing in the scanning direction along with extending in the scanning direction (X-axis direction in FIG. 7) is provided in the main adjusting unit 94, and a rack 102 displacing in the scanning direction along with extending in the scanning direction is provided in the sub-gap adjusting unit 96 as well.

The synchronization unit 98 is configured to include a first transfer gear 104 engaging with the rack 100, a second transfer gear 106 engaging with the first transfer gear, a pinion gear shaft 108 engaging with the second transfer gear and extending between the main gap adjusting unit 94 and the sub-gap adjusting unit 96, a third transfer gear 110 engaging with the pinion gear shaft, and a fourth transfer gear 112 engaging with the third transfer gear and the rack 102. That is, one side of the synchronization unit 98 engages with the main gap adjusting unit 94, and the other side engages with the sub-gap adjusting unit 96.

When the rack 100 is displaced in the scanning direction, the synchronization unit 98 converts the linear movement of the rack 100 to rotary movement with the first transfer gear 104, and transfers the rotary movement to the rack 102 with the fourth transfer gear 112 as linear movement via the second transfer gear 106, the pinion gear shaft 108 and third transfer gear 110. That is, the rack 102 is moved by synchronization of the synchronization unit 98 in the same direction as the direction in which the rack 100 moves.

In addition, the synchronization unit 98 has a configuration connecting between the main gap adjusting unit 94 and the sub-gap adjusting unit 96 with a mechanism of a plurality of gears or the like, and is able to cause power causing the housing 88 of the main gap adjusting unit 94 to be displace to be transferred to the sub-gap adjusting unit 96 when the housing 88 of the carriage 50 is caused to be displaced in the direction in which the main gap adjusting unit 94 causes the gap PG to change.

The main gap adjusting unit 94 is shown, with reference to FIG. 8A. The main gap adjusting unit 94 is configured to include a sliding member 114 as a "first sliding member" abutting the main guide rail 66, and sliding with respect to the main guide rail 66, a cam member 116 as a "first cam member" engaging with the sliding member, and an engaging member 118 engaging with the cam member.

The sliding member 114 extends in the X-axis direction as shown in FIG. 8B. Sliding portions 120 (refer to FIG. 6) abutting the sliding face 70 of the main guide rail 66 are provided at both ends in the X-axis direction of the lower face of the sliding member 114 (−Z direction in FIG. 8B). In addition, regulating portions 122 abutting the housing 88 of the carriage 50 and regulating the motion in the X-axis direction of the main gap adjusting unit 94 with respect to the housing 88 are provided at both ends in the X-axis direction of the sliding member 114.

In addition, in the sliding member 114, an engaging member 124 engaging with the cam member 116 is formed at one side in the Y-axis direction (+Y direction side in FIG. 8B). The engaging member 124 is formed in a step-shape corresponding to the shape of the cam portion 138 of the cam member 116 described later. Furthermore, in the sliding member 114, a guide pin 126 guiding the engaging member 118 is provided at one side.

In addition, in the upper face of the sliding member 114, a plurality of contact portions 130 contacting the cam portions 138 of the cam member 116 described later are provided. A hook portion 132 latching a first spring member 128 as a first biasing member described later is provided at both ends in the X-axis direction of the upper face of the sliding member 114.

The cam member 116 is shown in FIG. 9A and FIG. 9B. A rack 100 is formed on the upper face of the cam member 116. In addition, the upper face of the cam member 116 abuts the housing 88 of the carriage 50, and functions as a support face 134 supporting the housing 88. A first engaging pin 136 engaging with the engaging portion 124 of the sliding member 114 is provided on one side face of the cam member 116 in the Y-axis direction (refer to FIG. 9B).

In addition, a step-shape cam portion 138 is provided on one side face of the cam member 116. The cam portion 138 has a first step portion 138*a*, a second step portion 138*c*, a third step portion 138*e* and a fourth step portion 138*g* as "gap maintaining faces", and a first inclined portion 138*b*, a second inclined portion 138*d* and a third inclined portion 138*f* as "gap adjusting faces".

Any of the first step portion 138*a*, the second step portion 138*c*, the third step portion 138*e* and the fourth step portion 138*g* engages with the contact portion 130 of the sliding member 114, and maintains the gap PG along with regulating the gap PG. In addition, the first inclined portion 138*b*, the second inclined portion 138*d*, and the third inclined portion 138*f* cause the gap PG to change when the cam member 116 slides with respect to the sliding member 114. Moreover, each step portion 138*a*, 138*c*, 138*e*, 138*g* and each inclined portion 138*b*, 138*d*, 138*f* are arranged in an alternating step-shape in the cam portion 138.

In addition, on the other side face in the Y-axis direction of the cam member 116 (+Y direction side in FIG. 9A), a second engaging pin 140 as a "protrusion" engaging with the engaging member 118 is formed, and an engaging portion 142 engaging with the housing 88 of the carriage 50 is further formed.

An engaging member 118 is shown in FIG. 10. The engaging member 118 is formed as a plate-shaped member extending in the X-axis direction. On the engaging member 118, a guide groove 144 extending in the X-axis direction to which the engaging member 118 is guided by the guide pin 126 due to the guide pin 126 of the sliding member 114 being loosely inserted is provided. In addition, a elongated hole 146 into which the second engaging pin 140 of the cam member 116 is loosely inserted is provided in the engaging member 118.

The elongated hole 146 extends by inclining in the X-axis direction, as well as extending in the Z-axis direction. The elongated hole 146 is tilted by a predetermined angle with respect to the Z-axis direction, that is, the direction in which the gap PG changes, so as to be guided in the elongated hole 146 in the direction the second engaging pin 140 is to move accompanying sliding of the engaging member 118, in the X-axis direction. In addition, on the engaging member 118, a projection 148 is provided on the side (+Y direction side in FIG. 10) opposite the side engaging with the cam member 116 (−Y direction side in FIG. 10) in the Y-axis direction.

The projection 148 protrudes to the Y direction side (refer to FIG. 10) from the opposite side. In addition, the projection 148 according to the embodiment is provided on the lower end portion in the Z-axis direction of the engaging member 118 in order to reduce the swing radius of the switching lever 152 described later. Moreover, the engaging member 118 is configured so as to slide in the X-axis direction, that is, the scanning direction, and not to slide in the Z-axis direction, when slid with respect to the sliding member 114. Therefore, the projection 148 displaces in the X-axis direction, but does not displace in the Z-axis direction.

That is, the projection 148 holds a constant position in the direction in which the gap PG changes. Therefore, it is possible to reduce the size in a direction in which the gap PG changes of the projection 148 abutting on the tip portion 152*a* of the switching lever 152 described later, and the size in a direction in which the gap PG changes of the tip portion 152*a*.

Here, the relationship between the sliding member 114, the cam member 116 and the engaging member 118 in the main gap adjusting unit 94 will be described with reference to FIG. 11. FIG. 11 shows the cross-section in the Y-axis direction of the main gap adjusting unit 94 in FIG. 8A.

The sliding member 114 is arranged in a region surrounded by the sliding face 70, the guide face 74 and the regulation portion 76 of the main guide rail 66. Therefore, relative displacement of the sliding member 114 with respect to the main guide rail 66 in the Z-axis direction is regulated. In addition, the sliding face 70 and the sliding portion 120 of the sliding member 114 are in sliding contact.

In addition, a second spring member 150 as a "second biasing member" is provided at both ends in the X-axis direction of the sliding member 114, as shown in FIG. 8A. The second spring member 150 is arranged between the sliding member 114 and the housing 88 of the carriage 50, and biases the sliding member 114 to the guide face 74 by the biasing force thereof. Therefore, the sliding member 114 is able to prevent rattling in the Y-axis direction when sliding in the scanning direction with respect to the main guide rail 66, that is, the X-axis direction.

The first engaging pin 136 of the cam member 116 is received in the engaging portion 124 of the sliding member 114. The engaging portion 124 allows displacement of the cam member 116 according to the shape of the cam portion 138 in the Z-axis direction along with the X-axis direction, and regulates displacement of the cam member 116 not according to the shape of the cam portion 138 in the Z-axis direction, when the cam member 116 slides according to the shape of the cam portion 138 with respect to the sliding member 114.

In addition, the one end of the first spring member 128 is latched to the hook portion 132 of the sliding member 114, and the other end of the first spring member 128 is attached to the housing 88 of the carriage 50. Therefore, the cam member 116 is biased to the housing 88 by the biasing force of the first spring member 128 via the sliding member 114. Therefore, it is possible to reduce rattling in the Z-axis direction between the sliding member 114 and the housing 88.

Moreover, since the sliding member 114 is attached to the sliding face 70 of the main guide rail 66 by the weight of the carriage 50 itself, floating of the carriage 50 from the sliding face 70 is suppressed, or floating is able to be prevented, when the carriage 50 moves in the scanning direction.

In addition, the engaging portion 142 of the cam member 116 engages with a portion of the housing 88 of the carriage 50, and regulates displacement in the Z-axis direction such that the cam member 116 does not drop from the housing 88. The engaging member 118 is arranged between the cam member 116 and the housing 88, and is slidable in the X-axis direction along with the cam member 116.

Next, the gap PG will be described with reference to FIG. 12 and FIG. 13. In FIG. 12, the first step portion 138*a* of the cam portion 138 of the cam member 116 and the contact portion 130 of the sliding member 114 are in a state of contact. In this case, the thickness in the Z-axis direction of the first step portion 138*a* is set such that the gap PG between the lower guide member 48 supporting the paper P and the recording head 46 of the carriage 50 becomes the minimum.

In FIG. 13, the fourth step portion 138*g* of the cam portion 138 of the cam member 116 and the contact portion 130 of the sliding member 114 are in a state of contact. In this case, the thickness in the Z-axis direction of the fourth step portion 138*g* is set such that the gap PG between the lower guide member 48 supporting the paper P and the recording head 46 of the carriage 50 becomes the maximum.

When the engaging member 118 is caused to slide in the X-axis direction with respect to the sliding member 114, the second engagement pin 140 of the cam member 116 loosely inserted in the elongated hole 146 is guided along the elongated hole 146. As a result, the cam member 116 also slides in the Z-axis direction, along with sliding in the X-axis direction with respect to the sliding member 114. The contact portion 130 of the sliding member 114, along with sliding, engages the first step portion 138*a*, the first inclined portion 138*b*, the second step portion 138*c*, the second inclined portion 138*d*, the third step portion 138*e*, the third inclined portion 138*f* and the fourth step portion 138*g* of the cam portion 138 of the cam member 116 in this order.

That is, the distance of the gap PG is able to be changed by the contact portion 130 engaging with each step portion 138*a*, 138*c*, 138*e* and 138*g* in this order when the cam member 116 slides in the X direction with respect to the sliding member 114, or the contact portion 130 engaging with each step portion 138*g*, 138*e*, 138*c*, and 138*a* in this order when the cam member 116 slides in the -X direction with respect to the sliding member 114.

Next, the switching unit of the main gap adjusting unit 94 and the switching method of the gap PG will be described with reference to FIGS. 14 to 17B. In FIG. 14 a switching lever 152 as a "switching member" is shown. The switching lever 152 is provided in the vicinity of one side end of the movable range of the carriage 50 in the X-axis direction (for example, the opposite side (80 column side) to the home position of the carriage 50). An opening portion 154 is provided in the main guide rail 66 corresponding to the position at which the switching lever 152 is provided. The switching lever 152 is attached to the swing shaft 156, and swings around the swing shaft 156 due to a driving source not shown in the drawings.

FIGS. 15A and 15B show a swinging state of the switching lever 152. FIG. 15A shows a state in which the switching lever 152 is caused to swing counter-clockwise with the swing shaft 156 as a center, and the tip portion 152*a* of the switching lever 152 is protruded to the movement region of the main gap adjusting unit 94 through the opening portion 154. In this state, the tip portion 152*a* of the switching lever 152 is able to engage with the projection 148 of the engaging member 118 of the main gap adjusting unit 94 moving in the X-axis direction.

Moreover, since the projection 148 is provided on the lower end portion of the engaging member 118, it is possible to shorten the distance from the swing shaft 156 to the tip portion 152*a* of the switching lever 152. In so doing, it is possible to shorten the swing radius of the switching lever 152 and it is possible to reduce the size of the opening portion 154 of the main guide rail 66.

FIG. 15B shows a state in which the switching lever 152 is caused to swing clockwise with the swing shaft 156 as a center, and the tip portion 152*a* of the switching lever 152 is retreated from the movement region of the main gap adjusting unit 94. In this state, the tip portion 152*a* of the switching lever 152 does not abut the projection 148 of the engaging member 118 of the main gap adjusting unit 94 moving in the X-axis direction.

Next, an operation when the gap PG between the recording head 46 and the lower guide member 48 supporting the paper P is increased will be described with reference to FIGS. 16A and 16B. FIG. 16A is before the gap PG is increased. On the other hand, FIG. 16B shows when the gap PG is increased. In a state where a paper P is not sent as shown in FIG. 16A, firstly, the carriage 50 is moved toward one end side at which the switching lever 152 is provided (the −X direction in FIG. 16A) in the X-axis direction.

Then, the projection 148 of the engaging member 118 is stopped by causing the carriage 50 to move up to a position toward the right side of the switching lever 152 in FIG. 16A. Thereafter, the tip portion 152*a* of the switching lever 152 as shown in FIG. 15A is brought to a state of being protruded to the movement region of the main gap adjusting unit 94 by causing the switching lever 152 to swing. That is, the tip portion 152*a* of the switching lever 152 is brought to a state able to abut with the projection 148 of the engaging member 118.

Next, the carriage 50 is caused to move in the −X direction as shown in FIG. 16B. In this case, the cam member 116 and the engagement member 118 tend to move in the −X direction along with the carriage 50; however, movement in the −X direction is impeded by the tip portion 152*a* of the switching lever 152 abutting on the projection 148 of the engaging member 118.

In so doing, the cam member 116 and the engagement member 118 move relatively in the X direction with respect to the carriage 50. Then, the contact location with the contact portion 130 of the sliding member 114 in the cam member 116 is able to be changed from the first step portion 138*a* to any of the second step portion 138*c*, the third step portion 138*e* or the fourth step portion 138*g*. Moreover, as one example in FIG. 16B, a condition changed to the second step portion 138*c* is shown.

Then, once the carriage 50 is stopped, the tip portion 152*a* of the switching lever 152 is brought to a retreated state from the movement region of the main gap adjusting unit 94 as shown in FIG. 15B by causing the switching lever 152 to swing. As a result, it is possible to lengthen the distance between the support face 134 supporting the housing 88 of the carriage 50 and the contract portion 130, and it is possible to increase the gap PG between the recording head 46 and the lower guide member 48 supporting the paper P.

Moreover, changing from the first step portion 138*a* to any of the second step portion 138*c*, the third step portion 138*e* or the fourth step portion 138*g* is performed by controlling the movement amount of the carriage 50. In addition, changing from the first step portion 138*a* to any of the second step portion 138*c*, the third step portion 138*e* or the fourth step portion 138*g* is described as one example; however, the second step portion 138*c* may be changed to the third step portion 138*e* or the fourth step portion 138*g*, and the third step portion 138*e* may be changed to the fourth step portion 138*g*. Even in such a case, since the operation is the same, description will not be repeated. Moreover, in the above description, the position at which the tip portion 152*a* of the switching lever 152 and the projection 148 engage is the inner side of the housing 88 of the carriage 50 in the scanning direction (X-axis direction).

Next, an operation when the gap PG between the recording head 46 and the lower guide member 48 supporting the paper P is reduced will be described with reference to FIGS. 17A and 17B. FIG. 17A is before the gap PG is reduced. On the other hand, FIG. 17B shows when the gap PG is reduced. In a state where a paper P is not sent as shown in FIG. 17A, firstly, the carriage 50 is moved toward one end side at which the switching lever 152 is provided (the X direction in FIG. 17A) in the X-axis direction.

Then, the projection 148 of the engaging member 118 is stopped by causing the carriage 50 to move up to a position toward the left side of the switching lever 152 in FIG. 17A. Thereafter, the tip portion 152*a* of the switching lever 152 as shown in FIG. 15A is brought to a state of being protruded to the movement region of the main gap adjusting unit 94 by causing the switching lever 152 to swing.

Next, the carriage 50 is caused to move in the X direction as shown in FIG. 17B. In this case, the cam member 116 and the engagement member 118 tend to move in the X direction along with the carriage 50; however, movement in the X direction is impeded by the tip portion 152*a* of the switching lever 152 abutting on the projection 148 of the engaging member 118.

In so doing, the cam member 116 and the engagement member 118 move relatively in the −X direction with respect to the carriage 50. Then, the contact location with the contact portion 130 of the sliding member 114 in the cam member 116 is able to be changed from the fourth step portion 138*g* to any of the first step portion 138*a*, the second step portion 138*c*, or the third step portion 138*e*. Moreover, as one example in FIG. 16B, a condition changed to the first step portion 138*a* is shown.

Then, once the carriage 50 is stopped, the tip portion 152*a* of the switching lever 152 is brought to a retreated state from the movement region of the main gap adjusting unit 94 as shown in FIG. 15B by causing the switching lever 152 to swing. As a result, it is possible to shorten the distance between the support face 134 supporting the housing 88 of the carriage 50 and the contact portion 130, and it is possible to decrease the gap PG between the recording head 46 and the lower guide member 48 supporting the paper P.

Moreover, changing from the fourth step portion 138*g* to any of the first step portion 138*a*, the second step portion 138*c*, or the third step portion 138*e* is performed by controlling the movement amount of the carriage 50. In addition, changing from the fourth step portion 138*g* to any of the first step portion 138*a*, second step portion 138*c*, of the third step portion 138*e* is described as one example; however, the third step portion 138*e* may be changed to the second step portion 138*c* or the first step portion 138*a*, and the second step portion 138*c* may be changed to the first step portion 138*a*. Even in such a case, since the operation is the same, description will not be repeated. Moreover, in the above description, the position at which the tip portion 152*a* of the switching lever 152 and the projection 148 engage is the inner side of the housing 88 of the carriage 50 in the scanning direction (X-axis direction).

Next, the sub-gap adjusting unit 96 shown in FIG. 7 will be described. The sub-gap adjusting unit 96 includes a sliding member 158 as a "second sliding member" arranged on the front face side of the housing 88 of the carriage 50, and a cam member 160 as a "second cam member" to which operation of the main gap adjusting unit 94 is transferred by the synchronization unit 98 and engaging with the sliding member 158. The sub-gap adjusting unit 96 differs from the main gap adjusting unit 94 on the point of not including an engaging member.

Figure 18B:
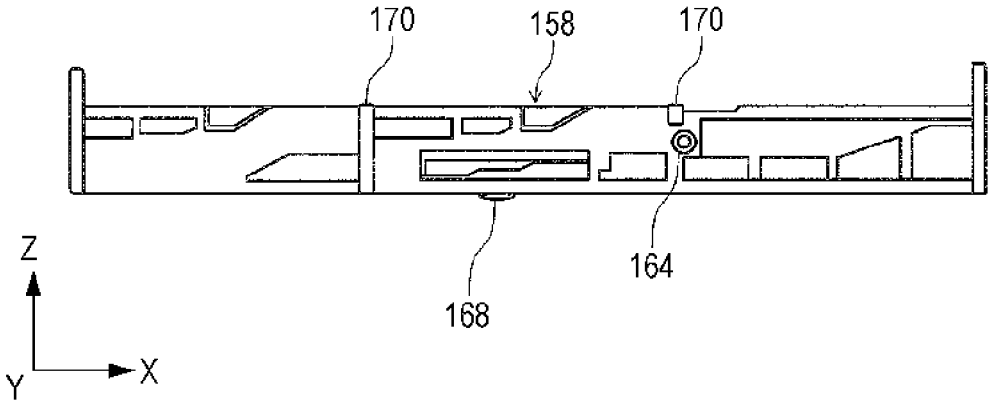
FIG. 18B is a rear view of a sliding member of a sub-gap adjusting unit.

The sliding member 158 will be described with reference to FIGS. 18A and 18B. An engaging portion 162 engaging with the cam member 160 provided on one side of the sliding member 158 in the Y-axis direction (refer to FIG. 18A). Furthermore, a regulating pin 164 regulating the relative displacement of the sliding member 158 with respect to the housing 88 in the X-axis direction is provided on the other side of the sliding member 158 in the Y-axis direction (refer to FIG. 18B). The regulating pin 164 engages with the regulation portion 166 provided close to the front face of the lower face of the housing 88 of the carriage 50 as shown in FIG. 6 (to the left in FIG. 6).

In addition, a sliding portion 168 (refer to FIG. 6) sliding in by contact with the sliding face 82 of the sub-guide rail 68 is provided in the vicinity of the center in the X-axis direction of the lower face of the sliding member 158. The sliding portion 168 is formed in an arc-shape protruding slightly to the sliding face 82 side from the vicinity of the center along the X-axis direction. In addition, in the upper face of the sliding member 158, a plurality of contact portions 170 contacting the cam portions 176 of the cam member 160 described later are provided.

Next, the cam member 160 will be described with reference to FIGS. 19A and 19B. A rack 102 is formed on the upper face of the cam member 160. In addition, the upper face of the cam member 160 abuts the housing 88 of the carriage 50, and functions as a support face 172 supporting the housing 88. Furthermore, an engaging protrusion 174 engaging with the engaging portion 162 of the sliding member 158 is provided on one side face of the cam member 160 in the Y-axis direction (refer to FIG. 19A).

In addition, a step-shape cam portion 176 is provided on one side face of the cam member 160. The cam portion 176 has a first step portion 176*a*, a second step portion 176*c*, a third step portion 176*e* and a fourth step portion 176*g* as "gap maintaining faces", and a first inclined portion 176*b*, a second inclined portion 176*d* and a third inclined portion 176*f* as "gap adjusting faces".

Any of the first step portion 176*a*, the second step portion 176*c*, the third step portion 176*e* and the fourth step portion 176*g* engages with the contact portion 170 of the sliding member 158, and maintains the gap PG along with regulating the gap PG. In addition, the first inclined portion 176*b*, the second inclined portion 176*d*, and the third inclined portion 176*f* cause the gap PG to change when the cam member 160 slides with respect to the sliding member 158. Moreover, each step portion 176*a*, 176*c*, 176*e*, 176*g* and each inclined portion 176*b*, 176*d*, 176*f* are arranged in a alternating step-shape in the cam portion 176. In addition, an engaging portion 178 engaging with the front face of the housing 88 of the carriage 50 is provided on the other side face of the cam member 160 in the Y-axis direction (refer to FIG. 19A).

In the sub-gap adjusting unit 96, the rack 102 is caused to be moved in the same direction as the main gap adjusting unit 94 by the synchronization unit 98, and the cam member 160 slides in the X-axis direction with respect to sliding member 158 supported by the housing 88. In this case, the contact portion 170 becomes engaged with any of each step portion 176*a*, 176*c*, 176*e*, or 176*g* of the cam portion 176 of the cam member 160.

Next, a comparison of the cam portion 138 of the cam member 116 of the main gap adjusting unit 94 and the cam portion 176 of the cam member 160 of the sub-gap adjusting unit 96 will be described with reference to FIGS. 20A and 20B. FIG. 20A shows the cam portion 138 of the cam member 116 of the main gap adjusting unit 94, and FIG. 20B shows the cam member 160 of the sub-gap adjusting unit 96.

Moreover, in FIGS. 20A and 20B, t1 to t8 indicate the distance between the support faces 134 and 172 and each of the step portions 138*a*, 138*c*, 138*e*, 138*g*, 176*a*, 176*c*, 176*e* and 176*g*, and L1 to L8 represent the length of the step portions in the X-axis direction of each of the step portions 138*a*, 138*c*, 138*e*, 138*g*, 176*a*, 176*c*, 176*e* and 176*g*. In addition, the co-ordinates from X1 to X7 and X8 to X14 in the X-axis direction show the positions of the start point and final point of each step portion. In addition, the final point of the fourth step portion is not shown in the drawings.

Here, the distance t1 between the first step portion 138*a* of the cam portion 138 and the support face 134 and the distance t5 between the first step portion 176*a* of the cam portion 176 and the support face 172 match. In addition, the distance t2 between the second step portion 138*c* of the cam portion 138 and the support face 134, the distance t3 between the third step portion 138*e* and the support face 134 and the distance t4 between the fourth step portion 138*g* and the support face 134 respectively match the distance t6 between the second step portion 176*c* of the cam portion 176 and the support face 172, the distance t7 between the third step portion 176*e* and the support face 172 and the distance t8 between the fourth step portion 176*g* and the support face 172.

That is, the distances t1 to t8 between each of the step portions 138*a*, 138*c*, 138*e*, 138*g*, 176*a*, 176*c*, 176*e* and 176*g* and the support faces 134 and 172 are regulated so as to match the amount of change in the Z-axis direction of the main gap adjusting unit 94 and the amount of change in the Z-axis direction of the sub-gap adjusting unit 96. Therefore, it is possible to prevent tilting of the carriage 50 in the Y-axis direction, that is, the apparatus depth direction.

Incidentally, when the main gap adjusting unit 94 and the sub-gap adjusting unit 96 are caused to move in the X-axis direction in order to adjust the gap PG, there are cases of torsion occurring in the pinion gear shaft 108 as a result of the start of motion on the sub-gap adjusting unit 96 side being delayed with respect to the start of motion on the main gap adjusting unit 94 side in the synchronization unit 98. In addition, there are cases of the start of motion of the sub-gap adjusting unit 96 with respect to the start of motion of the main gap adjusting unit 94 even due to backlash of each gear.

Therefore, there are cases where the abutting position in contact portion 170 of the sliding member 158 in the sub-gap adjusting unit 96 and the cam portion 176 in the X-axis direction shifts in the opposite direction to the sliding direction of the main gap adjusting unit 94 and the sub-gap adjusting unit 96 in the scanning direction, that is, the X-axis direction, with respect to the abutting position in the X-axis direction of the contact portion 130 of the sliding member 114 and the cam portion 138 in the main gap adjusting unit 94.

Therefore, at least one of any of the lengths L5 to L8 in the scanning direction of each step portion 176*a*, 176*c*, 176*e* and 176*g* of the cam portion 176 is formed longer than the respective corresponding lengths L1 to L4 in the scanning direction of each step portion 138*a*, 138*c*, 138*e* and 138*g* *of the cam portion* 138.

In addition, at least one of any of the start positions X8, X10, X12 or X14 of each step portion 176*a*, 176*c*, 176*e* and 176*g* in the cam portion 176 is arranged shifted in the opposite direction to the sliding direction of the main gap adjusting unit 94 and the sub-gap adjusting unit 96 in the scanning direction, that is, the X-axis direction with respect to the start positions X1, X3, X5 and X7 of the respective corresponding step portions 138*a*, 138*c*, 138*e* and 138*g* in the cam portion 138.

Therefore, even if the start of motion on the sub-gap adjusting unit 96 side with respect to the start of motion on the main gap adjusting unit 94 side in the synchronization unit 98 is delayed, since the length in the scanning direction of each step portion of the cam portion 176 is formed longer than the length in the scanning direction of each step portion of the cam portion 138, and further the start position of each step portion of the cam portion 176 is arranged by shifting the position, the gap PG which the main gap adjusting unit 94 regulates and the gap PG which the sub-gap adjusting unit 96 regulates synchronize.

In so doing, there is no tilting of the carriage 50 and the recording head 46 in the depth direction of the apparatus, that is, the Y-axis direction, with respect to the paper P, and there is no concern or there is little concern of the recording quality being lowered.

If the description above is collected, the printer 10 according to the embodiments includes a recording head 46 performing recording on a paper P; a carriage 50 movable in the scanning direction of the recording head 46, that is, the X-axis direction; a main guide rail 66 guiding the carriage 50 in the scanning direction; a sub-guide rail 68 provided placed a predetermined distance in a direction intersecting the scanning direction with respect to the main guide rail 66 and guiding the carriage 50 in the scanning direction; a main gap adjusting unit 94 provided on the carriage 50, and causing the housing 88 of the carriage 50 to displace in a direction changing the gap PG between a lower guide member 48 supporting the paper P and the recording head 46, and interposed between the housing 88 of the carriage 50 and the main guide rail 66; a sub-gap adjusting unit 96 provided on the carriage 50 and causing the housing 88 of the carriage 50 to displace in a direction changing the gap PG and interposed between the housing 88 of the carriage 50 and the sub-guide rail 68; a synchronization unit 98 provided on the carriage 50 causing the main gap adjusting unit 94 and the sub-gap adjusting unit 96 to be synchronized.

The main gap adjusting unit 94 and the sub-gap adjusting unit 96 respectively include a rack 100 and 102; and the synchronization unit 98 includes transfer gears 104 and 110 engaging with each rack 100 and 102, and a pinion gear shaft 108 engaging with each transfer gear 104, 106, 110 and 112. A switching lever 152 able to advance and retreat with respect to the movement region of the main gap adjusting unit 94 accompanying the movement operation of the carriage 50, and engaging with the main gap adjusting unit 94 by advancing to the movement region, and causing the main gap adjusting unit 94 to execute gap switching is included; and the engaging position of the switching lever 152 and the main gap adjusting unit 94 is positioned in the housing 88 of the carriage 50 in the scanning direction.

The main gap adjusting unit 94 includes a first sliding member 114 sliding with respect to the main guide rail 66, and a first cam member 116 interposed between a portion of the housing 88 and the first sliding member 114, and including a shape causing the housing 88 of the carriage 50 to displace in a direction changing the gap PG by relatively sliding in the scanning direction with respect to the housing 88 and the first sliding member 114; the sub-gap adjusting unit 96 includes a second sliding member 158 sliding with respect to the sub-guide rail 68, and a second cam member 160 interposed between the housing 88 and the second sliding member 158, and having a shape causing the housing 88 of the carriage 50 to displace in a direction changing the gap PG by relatively sliding in the scanning direction with respect to the housing 88 and the second sliding member 158; the first cam member 116 and the second cam member 160 include cam portions 138 and 176 formed by arranging in an alternating step-shape gap maintaining faces 138*a*, 138*c*, 138*e*, 138*g*, 176*a*, 176*c*, 176*e* and 176*g* maintaining the gap PG and gap adjusting faces 138*b*, 138*d*, 138*f*, 176*b*, 176*d*, and 176*f* causing the gap to change, and at least one of the plurality of gap maintaining faces 176*a*, 176*c*, 176*e* and 176*g* the second cam member 160 includes is formed with a length in the scanning direction longer than the corresponding gap maintaining faces 138*a*, 138*c*, 138*e*, and 138*g* the first cam member 116 includes.

The position in the scanning direction of at least one of the plurality of gap maintaining faces 176*a*, 176*c*, 176*e*, and 176*g* the second cam member 160 includes is arranged with respect to the position of the corresponding gap maintaining faces 138*a*, 138*c*, 138*e*, and 138*g* the first cam member 116 includes, and shifted in a direction in which the slide operation of the second cam member 160 delays with respect to the slide operation of the first cam member 116.

Modification Example of First Embodiment (1) In the synchronization unit 98, instead of the pinion gear shaft 108, the configuration performed by a plurality of gear trains 180 between the second transfer gear 106 and the third transfer gear 110 as shown in FIG. 21.

(2) In place of the synchronization unit 98, the main gap adjusting unit 94 and the sub-gap adjusting unit 96 may be caused to synchronize by linking the main gap adjusting unit 94 and the sub-gap adjusting unit 96 with a linking member or the like.

(3) In addition, the configuration may be performed by the switching lever 152 provided on the main guide rail 66 side being provided on the sub-guide rail 68 side, and the projection 148 engaging with the switching lever 152 being provided on the sub-gap adjusting unit 96 side. Moreover, in this configuration, the synchronization unit 98 may cause the power causing the housing 88 of the carriage 50 to displace in a direction causing the gap PG to change to be transferred from the sub-gap adjusting unit 96 to the main gap adjusting unit 94.

(4) The configuration may be performed by the switching lever 152 provided on the main guide rail 66 side being provided between the main guide rail 66 the sub-guide rail 68 in a direction travelling straight in the scanning direction, and the projection 148 engaging with the switching lever 152 being provided on the pinion gear shaft 108. Moreover, in this configuration, the synchronization unit 98 causes the power causing the housing 88 of the carriage 50 to displace in a direction causing the gap PG to change to be transferred to the pinion gear shaft 108 via the projection 148, and to be transferred to both the main gap adjusting unit 94 and the sub-gap adjusting unit 96 by causing the pinion gear shaft to rotate.

(5) The configuration may be performed by providing a driving motor between the main gap adjusting unit 94 and the sub-gap adjusting unit 96 in the synchronization unit 98, and the main gap adjusting unit 94 and the sub-gap adjusting unit 96 being operated by the driving motor so as to cause the housing 88 of the carriage 50 to be displace in a direction causing the gap PG to change.

In addition, in the embodiment, the gap adjusting unit 92 according to the invention is applied to an ink jet printer as one example of a recording apparatus; however, application is usually also possible to other liquid ejecting apparatuses.

Here, the liquid ejecting apparatus is not limited to a printer, copy machine, fax machine or the like in which an ink jet type recording head is used and performing recording on a recording medium by ejecting ink from the recording head, and includes an apparatus ejecting in place of ink a liquid corresponding to the uses from a liquid ejecting head corresponding to an ink jet recording head to an ejection target medium corresponding to a recording medium, and the liquid is attached to the ejection target medium.

As a liquid ejecting head, in addition to the recording head, examples include a color material ejecting head used in the manufacturing of a color filter of a liquid crystal display or the like, an electrode material (conductive paste) ejecting head used in electrode formation of an organic EL display or a field emission display (FED) or the like, or a bio-organic ejecting head used in biochip manufacturing, or a sample ejecting head as a precision pipette.

The invention is not limited to the embodiments described above and may be modified in various ways within the aspects disclosed in claims, and the modifications should be construed as being included in the invention.

The entire disclosure of Japanese Patent Application No. 2012-152144, filed Jul. 6, 2012 is expressly incorporated by reference herein.

What is claimed is:

1. A recording apparatus including a recording head performing recording on a recording medium, the apparatus comprising:

a carriage movable in a scanning direction of the recording head;

a first guide member guiding the carriage in the scanning direction;

a second guide member guiding the carriage in the scanning direction, and provided positioned at a predetermined distance in a direction intersecting the scanning direction with respect to the first guide member;

a first gap adjusting unit provided on the carriage, and interposed between the housing of the carriage and the first guide member and causing the housing of the carriage to displace in a direction changing the gap between a support face supporting a recording medium and the recording head;

a second gap adjusting unit provided on the carriage, and interposed between the housing of the carriage and the second guide member and causing the housing of the carriage to displace in a direction changing the gap;

a synchronization unit provided on the carriage causing the first gap adjusting unit and the second gap adjusting unit to engage with each other, and causing the first gap adjusting unit and the second gap adjusting unit to be synchronized by transferring power from one of the first gap adjusting unit and the second gap adjusting unit to the other in the carriage.

2. The recording apparatus according to claim 1, wherein, the first gap adjusting unit and the second gap adjusting unit each include a rack; and the synchronization unit includes transfer gears engaging with each rack, and pinion gears engaging with each transfer gear.

3. The recording apparatus according to claim 1, further comprising:

a switching member able to advance and retreat with respect to the movement region of the first gap adjusting unit accompanying the movement operation of the carriage, and engaging with the first gap adjusting unit by advancing to the movement region, and causing the first gap adjusting unit to execute gap switching, wherein the engaging position of the switching member and the first gap adjusting unit is positioned in the housing of the carriage in the scanning direction.

4. The recording apparatus according to claim 1, wherein the first gap adjusting unit includes a first sliding member sliding with respect to the first guide member, and a first cam member interposed between a portion of the housing and the first sliding member, and including a shape causing the housing of the carriage to displace in a direction changing the gap by relatively sliding in the scanning direction with respect to the housing and the first sliding member;

the second gap adjusting unit includes second sliding member sliding with respect to the second guide member, and a second cam member interposed between a portion of the housing and the second sliding member, and having a shape causing the housing of the carriage to displace in a direction changing the gap by relatively sliding in the scanning direction with respect to the housing and the second sliding member;

the first cam member and the second cam member include cam portions formed by arranging in an alternating step-shape a gap maintaining face maintaining the gap and a gap adjusting face causing the gap to change, and at least one of the plurality of gap maintaining faces the second cam member includes is formed with a length in the scanning direction longer than the corresponding gap maintaining face the first cam member includes.

5. The recording apparatus according to claim 4, wherein the position in the scanning direction of at least one of the plurality of gap maintaining faces the second cam member includes is arranged shifted in a direction in which the slide operation of the second cam member delays with respect to the slide operation of the first cam member with respect to the position of the corresponding gap maintaining face the first cam includes.

6. The recording apparatus according to claim 1, wherein the first gap adjusting unit includes a first sliding member sliding with respect to the first guide member, a first cam member interposed between a portion of the housing and the first sliding member, and including a shape causing the housing of the carriage to displace in a direction changing the gap by relatively sliding in the scanning direction with respect to the housing and the first sliding member;

the second gap adjusting unit includes a second sliding member sliding with respect to the second guide member, a second cam member interposed between a portion of the housing and the second sliding member, and including a shape causing the housing of the carriage to displace in a direction changing the gap by relatively sliding in the scanning direction with respect to the housing and the second sliding member, the first cam member and the second cam member include cam portions formed by arranging in an alternating step-shape a gap maintaining face maintaining the gap and a gap adjusting face causing the gap to change, and the position in the scanning direction of at least one of the plurality of gap maintaining faces the second cam member includes is arranged shifted in a direction in which the slide operation of the second cam member delays with respect to the slide operation of the first cam member, with respect to the position of the corresponding gap maintaining face the first cam includes.

* * * * *